US010012923B2

(12) United States Patent
Sano et al.

(10) Patent No.: US 10,012,923 B2
(45) Date of Patent: Jul. 3, 2018

(54) TONER

(71) Applicant: CANON KABUSHIKI KAISHA, Tokyo (JP)

(72) Inventors: Tomohisa Sano, Mishima (JP); Yusuke Hasegawa, Suntou-gun (JP); Yoshitaka Suzumura, Mishima (JP); Satoshi Arimura, Toride (JP); Takuma Ikejiri, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/490,174

(22) Filed: Apr. 18, 2017

(65) Prior Publication Data

US 2017/0307993 A1 Oct. 26, 2017

(30) Foreign Application Priority Data

Apr. 21, 2016 (JP) ..... 2016-085323

(51) Int. Cl.
*G03G 9/09* (2006.01)
*G03G 9/087* (2006.01)
(Continued)

(52) U.S. Cl.
CPC ..... *G03G 9/09733* (2013.01); *G03G 9/0819* (2013.01); *G03G 9/0825* (2013.01);
(Continued)

(58) Field of Classification Search
CPC ..... G03G 9/09733; G03G 9/0926; G03G 9/0825; G03G 9/091; G03G 9/0902; G03G 9/08711; G03G 9/0819
See application file for complete search history.

(56) References Cited

U.S. PATENT DOCUMENTS 6,703,176 B2 3/2004 Naka et al.
6,803,164 B2 10/2004 Mizoo et al.
(Continued)

FOREIGN PATENT DOCUMENTS

JP 2006-084953 A 3/2006
JP 2006-195260 A 7/2006
(Continued)

OTHER PUBLICATIONS

U.S. Appl. No. 15/256,780, filed Sep. 6, 2016, Yusuke Hasegawa.
(Continued)

*Primary Examiner* — Thorl Chea
(74) *Attorney, Agent, or Firm* — Fitzpatrick Cella Harper and Scinto

(57) ABSTRACT

Provided is a toner including toner particles, each of which contains a binder resin, a colorant, a releasing agent and a crystalline polyester, wherein in an observation of a cross-section each of the toner particles by transmission electron microscopy, specific toner particles each of which has domains of the crystalline polyester and domains of the releasing agent, are present at a ratio of at least 70% by number of the toner particles in the toner, an arithmetic mean of maximum diameters of the domains of the releasing agent is within prescribed range, and the specific toner particles satisfy prescribed conditions.

4 Claims, 2 Drawing Sheets

(51) Int. Cl.
*G03G 9/097* (2006.01)
*G03G 9/08* (2006.01)

(52) U.S. Cl.
CPC ..... *G03G 9/08711* (2013.01); *G03G 9/091* (2013.01); *G03G 9/0902* (2013.01); *G03G 9/0926* (2013.01)

(56) References Cited

U.S. PATENT DOCUMENTS

| | | | |
|---|---|---|---|
| 6,953,646 | B2 | 10/2005 | Doujo et al. |
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,704,659 | B2 | 4/2010 | Ogawa et al. |
| 7,745,085 | B2 | 6/2010 | Ishiyama et al. |
| 7,811,734 | B2 | 10/2010 | Ogawa et al. |
| 7,923,190 | B2 | 4/2011 | Magome et al. |
| 7,935,467 | B2 | 5/2011 | Dojo et al. |
| 7,939,231 | B2 | 5/2011 | Ogawa et al. |
| 8,084,174 | B2 | 12/2011 | Hasegawa et al. |
| 8,124,306 | B2 | 2/2012 | Hitata et al. |
| 8,227,162 | B2 | 7/2012 | Sane et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,918,035 | B2 | 12/2014 | Hasegawa et al. |
| 9,029,055 | B2 | 5/2015 | Aoki et al. |
| 9,097,997 | B2 | 8/2015 | Nomura et al. |
| 9,152,065 | B2 | 10/2015 | Sano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,316,937 | B2 | 3/2016 | Amemiya et al. |
| 9,377,708 | B2 | 6/2016 | Magome et al. |
| 9,423,710 | B2 | 8/2016 | Magome et al. |
| 9,454,096 | B2 | 9/2016 | Hasegawa et al. |
| 9,551,947 | B2 | 1/2017 | Hiroko et al. |
| 9,625,841 | B2 | 4/2017 | Hiroko et al. |
| 9,625,842 | B2 | 4/2017 | Uratani et al. |
| 9,658,546 | B2 | 5/2017 | Tanaka et al. |
| 2009/0197192 | A1 | 8/2009 | Hiroko et al. |
| 2010/0151377 | A1* | 6/2010 | Uchino ..... G03G 9/0825 430/110.2 |
| 2015/0227067 | A1 | 8/2015 | Hasegawa et al. |
| 2015/0227068 | A1 | 8/2015 | Sano et al. |
| 2016/0139521 | A1 | 5/2016 | Tsuda et al. |
| 2016/0266509 | A1 | 9/2016 | Sano et al. |
| 2016/0378003 | A1 | 12/2016 | Arimura et al. |

FOREIGN PATENT DOCUMENTS

| | | | |
|---|---|---|---|
| JP | 2008-033057 | A | 2/2008 |
| JP | 2010-164962 | A | 7/2010 |
| JP | 2015-011054 | A | 1/2015 |
| JP | 2016-042134 | A | 3/2016 |

OTHER PUBLICATIONS

U.S. Appl. No. 15/259,114, filed Sep. 8, 2016, Yoshitaka Suzumura.
U.S. Appl. No. 15/259,293, filed Sep. 8, 2016, Yoshitaka Suzumura.
U.S. Appl. No. 15/361,583, filed Nov. 28, 2016, Yuujirou Nagashima.
U.S. Appl. No. 15/362,992, filed Nov. 29, 2016, Satoshi Arimura.
U.S. Appl. No. 15/366,295, filed Dec. 1, 2016, Yoshitaka Suzumura.
U.S. Appl. No. 15/416,055, filed Jan. 26, 2017, Takashi Matsui.
U.S. Appl. No. 15/467,274, filed Mar. 23, 2017, Satoshi Arimura.
U.S. Appl. No. 15/586,732, filed May 4, 2017, Yusuke Hasegawa.
U.S. Appl. No. 15/596,693, filed May 16, 2017, Takuma Ikejiri.

* cited by examiner

TONER

BACKGROUND OF THE INVENTION

Field of the Invention

The present invention relates to a toner for use in recording methods using electrophotography and the like.

Description of the Related Art

Various electrophotographic methods are known. In general, a photoconductive material is used to form an electrostatic latent image by various means on an electrostatic latent image bearing member (hereunder also called a "photosensitive member"). The latent image is then developed with a toner to obtain a visible image, and the toner image is transferred as necessary to a recording medium such as paper, and then fixed on the recording medium by heat, pressure or the like to obtain a copied article. Examples of image-forming apparatuses using such electrophotographic methods include copiers and printers.

Such printers and copiers are increasingly digital rather than analog, and there is increasing demand for high resolution with excellent latent image reproducibility, as well as stable image quality even with long-term use. Toners with good fixing performance are also in demand as a means of saving energy, and attempts have been made to improve fixing performance by improving the melt viscosity of the binder resin and the like.

Even using such toners with improved fixing performance, however, there have been problems of "peeling", which is a partial separation of the toner after printing. Peeling is more likely to occur in areas where the toner laid-on level is high, and is thought to occur because the toner melt properties are inadequate, or because the release properties between the toner and the fixing member are insufficient.

The problem of fixing performance is addressed by many conventional techniques (see for example Japanese Patent Application Publication No. 2006-84953, Japanese Patent Application Publication No. 2008-33057 and Japanese Patent Application Publication No. 2010-164962). However, peeling of areas with a high toner laid-on level is not sufficiently addressed even by these proposals, and there is still room for improvement.

Moreover, conventionally toners with improved fixing performance have often been deficient in storability, and it is particularly difficult to maintain image quality when the toner is stored for a long period of time and then used for a long period of time in an environment likely to cause toner deterioration, such as a high-temperature, high-humidity environment. These problems have not been sufficiently addressed by prior art, and there is room for further improvement.

SUMMARY OF THE INVENTION

It is an object of the invention to solve problems such as those described above. Specifically, it is an object to provide a toner that is resistant to peeling and also to loss of image quality even after long-term storage.

This is a toner comprising toner particles, each of which contains a binder resin, a colorant, a releasing agent and a crystalline polyester, wherein in an observation of a cross-section of each of the toner particles by transmission electron microscopy, specific toner particles, each of which has domains of the crystalline polyester and domains of the releasing agent, are present at a ratio of at least 70% by number of the toner particles in the toner, an arithmetic mean of maximum diameters of the domains of the releasing agent is at least 1.0 μm and not more than 4.0 μm, and the specific toner particles satisfy conditions (i) to (iii):

(i) an average coverage ratio of the domains of the releasing agent by the domains of the crystalline polyester is at least 80%;

(ii) an average ratio of an area occupied by the domains of the crystalline polyester to a cross-sectional area of each of the specific toner particles is at least 10.0% and not more than 40.0%; and (iii) an average ratio of an area occupied by the domains of the releasing agent to a cross-sectional area of each of the specific toner particles is at least 10.0% and not more than 40.0%.

Further features of the present invention will become apparent from the following description of exemplary embodiments with reference to the attached drawings.

DESCRIPTION OF THE EMBODIMENTS

Figure 1:
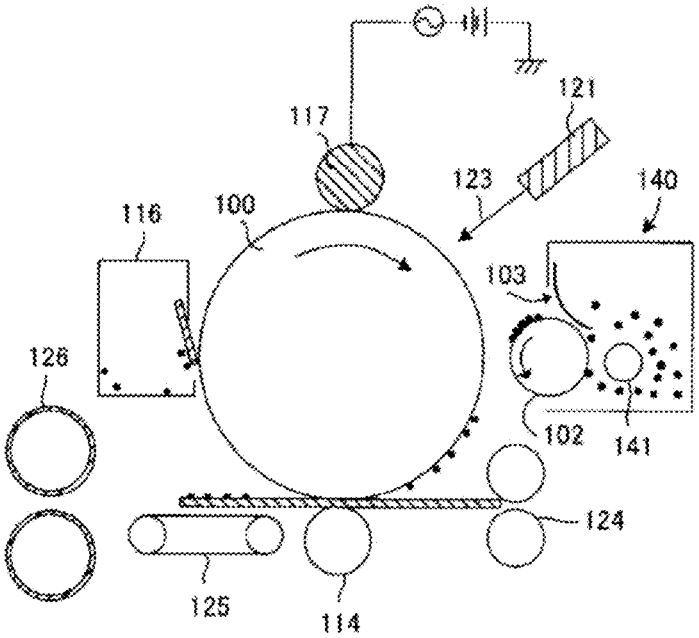
FIG. 1 is a model cross-section illustrating one example of an image-forming apparatus.

Unless otherwise specified, numerical ranges such as "at least A and not more than B" or "A to B" in the present invention include the minimum and maximum values at either end of the range.

The inventors discovered as a result of earnest research that a dramatic effect on peeling could be obtained by forming specific domains of both a crystalline polyester and a releasing agent inside the toner particle, and covering the surface of the releasing agent with the crystalline polyester. The present invention was reached when the inventors also discovered that in addition to fixing performance, stable image quality after long-term storage could be obtained with this structure.

"Peeling" is considered first. Peeling is a phenomenon that occurs in a printed image because part of the toner is easily removable from the media. Many causes for this are possible, but the inventors focused on the following. The fixing step is a step of fixing the toner by applying pressure and heat to a layer of toner on the media, but if the toner layer is thick, the heat may not penetrate thoroughly to the lower layer, which may thus remain largely unmelted. Meanwhile, the upper layer of the toner layer is required to not only melt during fixing, but also to simultaneously provide a sufficient release function by means of a wax or the like. If the release function is insufficient, the toner layer may be pulled onto the fixing member.

When such problems occur in the upper toner layer or lower toner layer, the toner after fixing often has a weak bonding force with respect to the paper or other media. Consequently, when the printed image is rubbed for example the entire toner layer may peel off if the bonding force is weak. This is the problem addressed by the present invention, called "peeling" by the inventors.

The inventors discovered that peeling could be greatly improved by controlling both the melting properties and release performance by means of a configuration such as the following. Specifically, this is a toner comprising toner particles, each of which contains a binder resin, a colorant, a releasing agent and a crystalline polyester, wherein in an observation of a cross-section of each of the toner particles by transmission electron microscopy, specific toner particles, each of which has domains of the crystalline polyester and domains of the releasing agent, are present at a ratio of at least 70% by number of the toner particles in the toner, an arithmetic mean of maximum diameters of the domains of the releasing agent is at least 1.0 μm and not more than 4.0 μm, and the specific toner particles satisfy conditions (i) to (iii):

(i) an average coverage ratio of the domains of the releasing agent by the domains of the crystalline polyester is at least 80%;

(ii) an average ratio of an area occupied by the domains of the crystalline polyester to a cross-sectional area of each of the specific toner particles is at least 10.0% and not more than 40.0%; and (iii) an average ratio of an area occupied by the domains of the releasing agent to a cross-sectional area of each of the specific toner particles is at least 10.0% and not more than 40.0%.

It is important that a releasing agent be present in the form of large-diameter domains in the toner of the invention, and that the crystalline polyester cover these domains to a certain thickness. In terms of behavior during the fixing step, when the toner is subjected to heat the crystalline polyester nearer the surface melts first, and then the releasing agent in the interior begins to melt. The crystalline polyester plasticizes the surrounding binder resin as it spreads inside the toner particle, and in this case it is thought that the melted releasing agent follows the paths previously plasticized and softened by the crystalline polyester, and continues to plasticize the surrounding material as it is exuded onto the toner surface. It is thought that remarkable release performance is obtained because this process makes full use of the plasticizing properties of both the crystalline polyester and the releasing agent, while causing a large quantity of the releasing agent to be rapidly exuded onto the toner surface.

The necessary conditions for obtaining these effects are explained here.

Because the toner is configured with the crystalline polyester covering the releasing agent, it must be formed primarily of particles having both domains of the crystalline polyester and domains of the releasing agent in the same individual particle. According to the researches of the inventors, it is important that toner particles having both kinds of domains (such a toner particle is sometimes called "Tcw" below) account for at least 70% of the particles in the toner. According to the researches of the inventors, it is important to control the states of the crystalline polyester and releasing agent in these Tcw particles. The percentage of Tcw particles is preferably at least 80%, and while there is no upper limit, it is preferably not more than 100%.

A toner particle cross-section is observed by TEM to confirm whether the particle is a Tcw. The toner is cut to obtain cross-sections for observation, and it is difficult to achieve a high Tcw ratio unless either both are uniformly mixed in the toner, or else the crystalline polyester covers the releasing agent to a certain degree as in the present invention. The Tcw is preferably controlled by controlling the structure to increase affinity between the crystalline polyester and releasing agent, or by controlling the ratios of the two, or by selecting the toner manufacturing method (preferably, by selecting a method that includes a step of mixing and melting the crystalline polyester and releasing agent).

The melting point of the crystalline polyester is preferably within a range that does not adversely affect the storability, developing performance or fixing performance. Preferably the melting point is at least 55° C. and not more than 90° C. If the melting point is at least 55° C., developing performance is good after long-term storage. If the melting point is not more than 90° C., the crystalline polyester is easy to disperse, and developing performance is good because variation among toner particles is less likely to occur.

A large quantity of the releasing agent is required to obtain a satisfactory release effect, and the maximum diameter of the domains of the releasing agent in the Tcw is at least 1.0 μm and not more than 4.0 μm. From the standpoint of peeling and stable image quality, it is preferably at least 1.0 μm and not more than 3.6 μm. The maximum diameter of the releasing agent domains is preferably controlled for example by controlling the added amount of the releasing agent and the types and combination of the binder resin and releasing agent, as well as the toner manufacturing method and manufacturing conditions. For example the releasing agent domains can be easily controlled within this range if the manufacturing method is suspension polymerization. It is also desirable to include an additional step of promoting crystallization of the releasing agent, such as for example a step of maintaining the heat for 30 minutes or more at a temperature range of ±10° C. of the glass transition temperature of the toner.

The maximum diameter is obtained in TEM observation of a toner particle cross-section by measuring the diameter of the largest area domain out of the releasing agent domains from every angle, and taking the longest value.

Figure 2:
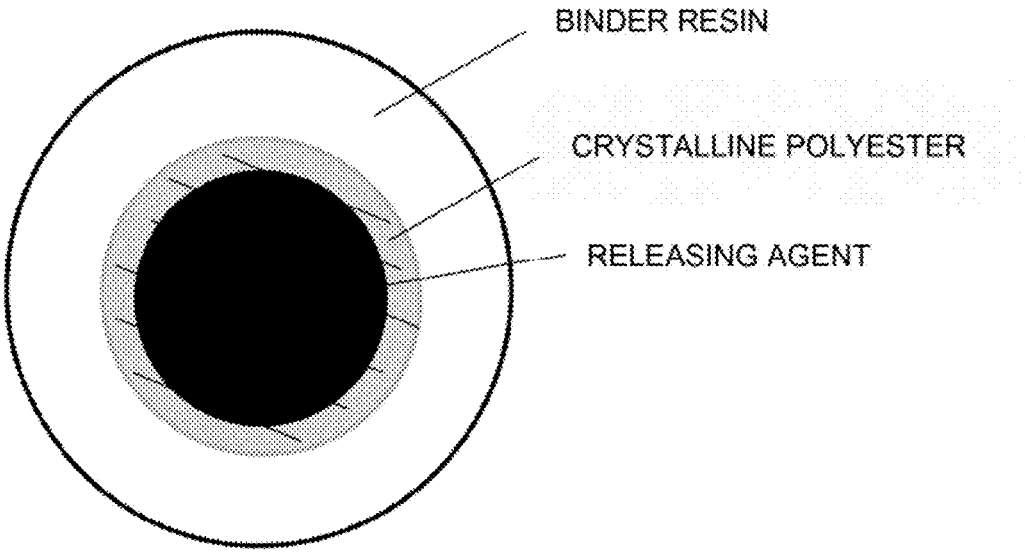
FIG. 2 is a model cross-section illustrating one example of the structure of a toner particle of the present invention.

In the Tcw, the crystalline polyester substantially covers the domains of the releasing agent. This is because the crystalline polyester needs to melt and spread first during fixing as discussed above in order for the function of the releasing agent to be fully realized. The researches of the inventors have shown that the coverage ratio must be at least 80% based on the perimeter of the releasing agent domain. A coverage ratio below 80% is not desirable because obvious peeling is more likely. A coverage ratio of at least 85% is preferred from the standpoint of stable image quantity, and there is no particular upper limit, but not more than 100% is preferred. The coverage ratio is preferably controlled by selecting the types of the crystalline polyester and releasing agent, and by controlling the ratios of the two, the principal components of the binder resin, and the toner manufacturing methods and conditions. When the coverage ratio of the releasing agent domains by the crystalline polyester is 100%, a toner particle cross-section such as that shown in FIG. 2 is confirmed by TEM. It is desirable to combine a crystalline polyester and releasing agent having high affinity for one another, since this makes it easier to obtain a high coverage ratio. The researches of the inventors have shown that a combination of a crystalline polyester with a structure derived from a monocarboxylic acid or monoalcohol having a $C_{10-24}$ alkyl group with an ester wax having 2 to 6 ester groups tends to have high affinity.

It is also important that the respective domains of the crystalline polyester and releasing agent in the Tcw occupy a certain area ratio of the toner particle cross-sectional area. The researches of the inventors have shown that a certain degree of spreading is essential for achieving efficient plasticization and exudation during fixing. Specifically, the area ratio occupied by the crystalline polyester domains and the area ratio occupied by the releasing agent domains are preferably each at least 10.0% and not more than 40.0% of the toner particle cross-sectional area. From the standpoint of stable image quality, each area ratio is preferably at least 10.0% and not more than 38.5%.

The area ratio occupied by the crystalline polyester domains is preferably controlled by means of the content of the crystalline polyester and the composition of the binder resin, and by applying a method that promotes crystallization in the toner manufacturing method for example. The area ratio occupied by the releasing agent domains can be controlled by means of the content of the releasing agent and the composition of the binder resin, and by including a step of annealing near the crystallization temperature of the crystalline polyester in the toner manufacturing process or the like.

The image quality during long-term use in a high-temperature, high-humidity environment after long-term storage is discussed here. In a toner containing a releasing agent and a crystalline polyester as crystalline materials, the crystalline materials sometimes grow crystals and be precipitated on the surface during long-term storage. The friction coefficient within the toner increases under these conditions, promoting aggregation between toner particles for example, or increasing the likelihood of contamination of the toner carrying member or regulating member. Such phenomena are more conspicuous in high-temperature, high-humidity environments, and are often exacerbated by long-term use. The inventors have focused on the issue of durability performance after long-term storage.

In order to prevent toner deterioration during long-term storage, it is necessary to stabilize the crystalline materials (releasing agent and crystalline polyester). The inventors' researches have shown that it is important to grow large domains of the releasing agent. Moreover, durability performance after storage is dramatically improved if crystalline polyester domains as discussed above cover the releasing agent domains with a coverage ratio of at least 80%. The details are unclear, but it is thought that both the releasing agent and crystalline polyester are stabilized by forming relatively large domains in the toner particle, and the hardness of the toner particle is also increased when the large crystals are enveloped, leading to increased durability performance after long-term storage.

The toner of the invention is explained below by means of preferred embodiments.

To facilitate stable formation of specific domains of the releasing agent and crystalline polyester, it is desirable that the binder resin be made primarily of a styrene acrylic resin. "Made primarily of" here means that the component constitutes at least 70% of the mass of the binder resin. At least 80% is preferred from the standpoint of image stability. There is no particular upper limit, and not more than 100% is preferred. The styrene acrylic resin is discussed below.

The effects of the present invention are obtained when the crystalline polyester and releasing agent spread rapidly inside the toner particle. Preferably the interior of the toner particle has a structure in which fine domains such as the following are present in addition to large domains of the releasing agent and crystalline polyester.

Specifically, in a cross-section of the toner particle observed by scanning electronic microscopy, the total number of the releasing agent domains and crystalline polyester domains with a maximum diameter of at least 5 nm and not more than 500 nm is preferably at least 50 and not more than 500, or more preferably at least 80 and not more than 500 per individual toner particle cross-section. The amount of 5 to 500 nm domains is preferably within this range because this tends to encourage spreading of the crystalline polyester and releasing agent without adversely affecting storability or developing performance. The amount of 5 to 500 nm domains is preferably controlled by means of the types of the crystalline polyester and releasing agent and their combination with the binder resin composition, and by a step of promoting crystallization in the toner manufacturing process. A preferred method for promoting crystallization is by a step of cooling at a rate of at least 5.0° C./minute to within ±5° C. of the crystallization temperature from a temperature at or above the melting points of the crystalline polyester and releasing agent.

The crystalline polyester used in the present invention is discussed here.

A known crystalline polyester may be used, but a saturated polyester is preferred. A condensation product of an aliphatic dicarboxylic acid and an aliphatic diol is preferred, and a structure in which the aliphatic monocarboxylic acid is condensed at the ends is more preferred. A terminal structure derived from an aliphatic monocarboxylic acid not only makes it easier to adjust the molecular weight and hydroxyl value, but is also desirable for controlling affinity with the releasing agent. For example, the following monomers may be used.

Examples of aliphatic dicarboxylic acids include oxalic acid, malonic acid, succinic acid, glutaric acid, adipic acid, pimelic acid, suberic acid, azelaic acid, sebacic acid, dodecanedioic acid, hexadecanedicarboxylic acid and octadecanedicarboxylic acid.

Examples of aliphatic diols include ethylene glycol, diethylene glycol, triethylene glycol, 1,2-propanediol, 1,3-propanediol, dipropylene glycol, trimethylene glycol, neopentyl glycol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,16-hexadecanediol and 1,18-octadecanediol.

Examples of aliphatic monocarboxylic acids include decanoic acid (capric acid), dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid) and tetracosanoic acid (lignoceric acid). Because monocarboxylic acids have one carboxylic acid, a structure derived from the monocarboxylic acid is located at the end of the crystalline polyester. A combination of a crystalline polyester having a terminal $C_{10-24}$ alkyl group with an ester wax having 2 to 6 ester groups in the molecule is desirable for dramatically increasing the coverage ratio of the releasing agent by the crystalline polyester by increasing the affinity between the two.

The crystalline polyester used in the present invention is preferably a polyester having a terminal structure derived from an acid monomer selected from lauric acid, stearic acid and behenic acid, since this increases affinity for the ester wax as described above and also tends to increase the coverage ratio of the releasing agent by the crystalline polyester.

From the standpoint of the crystallinity of the crystalline polyester, the content of linear aliphatic dicarboxylic acids among the carboxylic acid components is preferably at least 80 mol % and not more than 100 mol %, or more preferably at least 90 mol % and not more than 100 mol %, or still more preferably at least 95 mol % and not more than 100 mol % from the standpoint of the crystallinity of the crystalline polyester.

From the standpoint of the crystallinity of the crystalline polyester, the content of linear aliphatic diols among the polyol components is preferably at least 80 mol % and not more than 100 mol %, or more preferably at least 90 mol % and not more than 100 mol %.

The melting point of the crystalline polyester is preferably at least 50° C. and not more than 95° C., or more preferably at least 55° C. and not more than 90° C., or still more preferably at least 55° C. and not more than 85° C. The melting point can be controlled by means of the combination of carboxylic acid component and alcohol component.

The crystalline polyester used in the present invention may be manufactured by normal polyester synthesis methods. For example, it can be obtained by an esterification reaction or ester exchange reaction of a dicarboxylic acid component and a diol component, followed a polycondensation reaction performed by ordinary methods under reduced pressure or with an introduced nitrogen gas.

An ordinary esterification catalyst or ester exchange catalyst such as sulfuric acid, tertiary butyl titanium butoxide, dibutyl tin oxide, manganese acetate or magnesium acetate may be used as necessary during the esterification reaction or ester exchange reaction. Moreover, an ordinary polymerization catalyst such as tertiary butyl titanium butoxide, dibutyl tin oxide, tin acetate, zinc acetate, tin disulfide, antimony trioxide, germanium dioxide or another known catalyst may be used for polymerization. The polymerization temperature and amount of the catalyst are not particularly limited, and may be selected at will as necessary.

The crystalline polyester preferably has a weight-average molecular weight (Mw) of at least 10,000 and not more than 60,000, or more preferably at least 25,000 and not more than 45,000. This is because this tends to facilitate phase separation between the crystalline polyester and the binder resin in the toner manufacturing process, resulting in superior developing performance.

The weight-average molecular weight (Mw) of the crystalline polyester can be controlled by means of the various manufacturing conditions and monomer composition of the crystalline polyester. In particular, the molecular weight tends to be lower when a monoalcohol or a monocarboxylic acid is used as a monomer. A monoalcohol and a monocarboxylic acid are preferably not used together when a molecular weight of at least 50,000 is desired.

The hydroxyl value (mg KOH/g) of the crystalline polyester is preferably kept low in order to increase the coverage ratio of the releasing agent by the crystalline polyester. It is thought that if the crystalline polyester has fewer OH groups in, it will have greater affinity for the releasing agent. Specifically, the value is not more than 40.0, or preferably not more than 30.0, or more preferably not more than 10.0.

Like the hydroxyl value, the acid value (mg KOH/g) of the crystalline polyester is preferably kept low in order to increase the coverage ratio of the releasing agent by the crystalline polyester. Specifically, the value is not more than 8.0, or preferably not more than 5.0, or more preferably not more than 4.5.

An amorphous polyester may also be combined with the crystalline polyester in the toner of the invention. This is expected to function not as a binder resin but as a shell layer for example. The amorphous polyester is contained in the amount of preferably at least 1.0 mass parts, or more preferably at least 1.0 and not more than 20.0 mass parts per 100 mass parts of the binder resin.

The releasing agent is discussed next. The peak temperature of crystallization of the releasing agent is preferably at least 50° C. and not more than 90° C.

The following are examples of the releasing agent: aliphatic hydrocarbon waxes such as low-molecular-weight polyethylene, low-molecular-weight polypropylene, microcrystalline wax, Fischer-Tropsch wax and paraffin wax; oxides of aliphatic hydrocarbon waxes, such as polyethylene oxide wax, and block copolymers of these; waxes composed primarily of aliphatic esters, such as carnauba wax and montanic acid ester wax, or of partially or wholly deoxidized aliphatic esters, such as deoxidized carnauba wax; saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linoleic acid amide, oleic acid amide and lauric acid amide; saturated fatty acid bisamides such as methylene bis-stearic acid amide, ethylene bis-capric acid amide, ethylene bis-lauric acid amide and hexamethylene bis-stearic acid amide; unsaturated fatty acid amides such as ethylene bis-oleic acid amide, hexamethylene bis-oleic acid amide, N,N'-dioleyl adipic acid amide and N,N'-dioleyl sebacic acid amide; aromatic bisamides such as m-xylene bis-stearic acid amide and N,N'-distearyl isophthalic acid amide; aliphatic metal salts such as calcium stearate, calcium laurate, zinc stearate, and magnesium stearate (commonly called metal soaps); waxes formed of vinyl monomers such as styrene or acrylic acid grafted to aliphatic hydrocarbon waxes; partial esterification products of fatty acids and polyhydric alcohols, such as behenic acid monoglyceride; and methyl ester compounds with hydroxy groups obtained by hydrogenation or the like of vegetable oils and fats.

In the present invention, a combination of an aliphatic hydrocarbon wax and a wax made primarily of a fatty acid ester (hereunder called an ester wax) is desirable for controlling affinity with the crystalline polyester.

The following are examples of ester waxes that can be used favorably in the present invention. Functionality as described below indicates numbers of ester groups per molecule. For example, behenyl behenate is a monofunctional ester wax, while dipentaerythritol hexabehenate is a hexafunctional ester wax.

A condensate of a $C_{6-12}$ aliphatic alcohol and a long-chain carboxylic acid or a condensate of a $C_{4-10}$ aliphatic carboxylic acid and a long-chain alcohol can be used as a monofunctional ester wax. Any long-chain carboxylic acid or long-chain alcohol may be used.

Examples of aliphatic alcohols include 1-hexanol, 1-heptanol, 1-octanol, 1-nonanol, 1-decanol, undecyl alcohol and lauryl alcohol. Examples of aliphatic carboxylic acids include pentanoic acid, hexanoic acid, heptanoic acid, octanoic acid, nonanoic acid and decanoic acid.

A condensate of a dicarboxylic acid and a monoalcohol or a condensate of a diol and a monocarboxylic acid may be used as a bifunctional ester wax.

Examples of dicarboxylic acids include adipic acid, pimelic acid, suberic acid, azelaic acid, sebacic acid and dodecanedioic acid.

Examples of diols include 1,6-hexanediol, 1,7-heptanediol, 1,8-octanediol, 1,9-nonanediol, 1,10-decanediol, 1,11-undecanediol and 1,12-dodecanediol.

An aliphatic alcohol is preferred as the monoalcohol for condensing with the dicarboxylic acid. Specific examples include tetradecanol, pentadecanol, hexadecanol, heptadecanol, octadecanol, nonadecanol, eicosanol, docosanol, tricosanol, tetracosanol, pentacosanol, hexacosanol and octacosanol. Of these, docosanol is preferred from the standpoint of fixing performance and developing performance.

An aliphatic carboxylic is preferred as the monocarboxylic acid for condensing with the diol. Specific examples include fatty acids such as lauric acid, myristic acid, palmitic acid, margaric acid, stearic acid, tuberculostearic acid, arachidic acid, behenic acid, lignoceric acid and cerotic acid. Of these, behenic acid is preferred from the standpoint of fixing performance and developing performance.

Linear fatty acids and linear alcohols were given as examples here, but branched structures are also possible.

A trifunctional or higher ester wax may also be used. A trifunctional or higher ester wax may be obtained as follows.

A trifunctional ester wax may be a condensate of a glycerin compound and a monofunctional aliphatic carboxylic acid. A tetrafunctional ester wax may be a condensate of pentaerythritol and a monofunctional aliphatic carboxylic acid, or a condensate of diglycerin and a carboxylic acid. A pentafunctional ester wax may be a condensate of triglycerin and a monofunctional aliphatic carboxylic acid. A hexafunctional ester wax may be a condensate of dipentaerythritol and a monofunctional aliphatic carboxylic acid, or a condensate of tetraglycerin and a monofunctional aliphatic carboxylic acid.

A bifunctional to hexafunctional ester wax is preferred because it has high affinity for the crystalline polyester, making it easier for the releasing agent domains to be covered by the crystalline polyester.

The content of the releasing agent is preferably at least 1.0 mass part and not more than 40.0 mass parts, or more preferably at least 3.0 mass parts and not more than 35.0 mass parts, or still more preferably at least 3.0 mass parts and not more than 30.0 mass parts per 100 mass parts of the binder resin.

The follow methods exist for analyzing the structure and content of the crystalline polyester used in the present invention and the content of the releasing agent, and are explained as examples. First, the toner is dissolved in chloroform, and the insoluble matter is removed with a Sample Pretreatment Cartridge H-25-2 (Tosoh Corporation) for example. The soluble matter is then introduced into preparative HPLC (using for example a LC-9130 NEXT column (60 cm), Japan Analytical Industry Co., Ltd.) to sort the molecular weights of less than 5,000 from those of 5,000 or more. The purpose of this operation is to separate the releasing agent from the crystalline polyester because the former normally has a high molecular weight and the latter an even higher molecular weight. The compositions of the releasing agent and crystalline polyester are then obtained from the sorted components by using a combination of a JPS-700 thermal analyzer (Japan Analytical Industry Co., Ltd.) and a GC-MASS (Thermo Fisher Scientific Inc.) for example. Each sorted component is then analyzed by $^{1}$H-NMR to calculate the amounts of the releasing agent and crystalline polyester relative to the binder resin and the ratios of the crystalline polyester and releasing agent.

The mass ratio of the crystalline polyester relative to the releasing agent (crystalline polyester/releasing agent) is preferably 0.25 to 4.0 from the standpoint of the effects of the invention.

Moreover, the amount of the crystalline polyester is preferably at least 5.0 mass parts and not more than 20.0 mass parts per 100 mass parts of the binder resin.

The following are examples of binder resins that can be used in the toner of the invention: homopolymers of styrene and its substitution products, such as polystyrene and polyvinyltoluene; styrene acrylic resins such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacrylate, polybutyl methacrylate, polyvinyl acetate, polyethylene, polypropylene, polyvinyl butyral, silicone resin, polyester resin, polyamide resin, epoxy resin and polyacrylic acid resin may be used, and these may be used alone or multiple types may be combined. Of these, styrene acrylic resins such as styrene-butyl acrylate are especially desirable from the standpoint of the developing characteristics, fixing performance and the like.

The following are examples of polymerizable monomers for forming the styrene acrylic resin. Examples of styrene polymerizable monomers include α-methylstryene, o-methylstyrene, m-methylstyrene, p-methylstyrene and p-methoxystyrene.

Examples of acrylic polymerizable monomers include methyl acrylate, ethyl acrylate, n-propyl acrylate, iso-propyl acrylate, n-butyl acrylate, iso-butyl acrylate, tert-butyl acrylate, n-hexyl acrylate, 2-ethylhexyl acrylate, n-octyl acrylate and cyclohexyl acrylate.

Examples of methacrylic polymerizable monomers include methyl methacrylate, ethyl methacrylate, n-propyl methacrylate, iso-propyl methacrylate, n-butyl methacrylate, iso-butyl methacrylate, tert-butyl methacrylate, n-hexyl methacrylate, 2-ethylhexyl methacrylate and n-octyl methacrylate.

The method of manufacturing the styrene acrylic resin is not particularly limited, and a known method may be used. Another known resin may also be combined in the binder resin.

The following organic pigments, organic dyes and inorganic pigments may be used as the colorant in the present invention.

Examples of cyan colorants include copper phthalocyanine compounds and their derivatives, anthraquinone compounds, and basic dye lake compounds.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds and perylene compounds.

Examples of yellow colorants include condensed azo compounds, isoindolinone compounds, anthraquinone compounds, azo metal complexes, methine compounds and allylamide compounds.

Examples of black colorants include carbon black and black colorants obtained by blending the aforementioned yellow colorants, magenta colorants and cyan colorants and magnetic powders.

These colorants may be used alone, or mixed, or used in solid solution. The colorant used in the present invention may be selected out of considerations of hue angle, chroma, lightness, light resistance, OHP transparency, and dispersibility in the toner particle.

When a magnetic powder is not used, the content of the colorant is preferably at least 1 mass part and not more than 20 mass parts per 100 mass parts of the binder resin or the polymerizable monomers constituting the binder resin. When a magnetic powder is used, the content is preferably at least 20 mass parts and not more than 200 mass parts, or more preferably at least 40 mass parts and not more than 150 mass parts per 100 mass parts of the binder resin or the polymerizable monomers constituting the binder resin.

When a magnetic powder is used in the present invention, the magnetic powder is preferably one made primarily of a magnetic iron oxide such as triiron tetraoxide or gamma iron oxide. An element such as phosphorus, cobalt, nickel, copper, magnesium, manganese, aluminum or silicon may also be included. The BET specific surface area of such a magnetic powder as measured by the nitrogen adsorption method is preferably 2 to 30 $m^2/g$, or more preferably 3 to 28 $m^2/g$. The Mohs hardness is preferably 5 to 7. Magnetic powder shapes include polyhedrons, octahedrons, hexahedrons, spheres, needles, flakes and the like, but a shape such as a polyhedron, octahedron, hexahedron or sphere with low anisotropy is preferred for increasing the image density.

The magnetic powder preferably has a number-average particle diameter of 0.10 to 0.40 μm. Although tinting strength is normally increased when the magnetic powder has a smaller particle diameter, this also makes the magnetic powder aggregate more easily, so the aforementioned range is preferred for balancing tinting strength and aggregation.

The number-average particle diameter of the magnetic powder can be measured by transmission electron microscopy. Specifically, the toner particle to be observed is first thoroughly dispersed in epoxy resin, which is then cured for 2 days in a 40° C. atmosphere to obtain a cured product. A thin section of the resulting cured product is taken as a sample with a microtome, and photographed at a magnification of 10,000 to 40,000 with a transmission electron microscope (TEM), and the diameters of 100 magnetic powder particles in the visual field are measured. The number-average particle diameter is then calculated based on the equivalent diameter of a circle equal to the projected area of the magnetic powder. The particle diameter can also be measured with an image analyzer.

The magnetic powder may be manufactured by the following methods for example. An alkali such as sodium hydroxide is added to a ferrous salt aqueous solution in an amount equivalent to or greater than the iron component, to prepare an aqueous solution containing ferrous hydroxide. Air is blown in with the pH of the aqueous solution maintained at pH 7 or more, and the aqueous solution is heated to at least 70° C. while performing an oxidation reaction on the ferrous hydroxide, to initially produce seed crystals which will serve as the core of a magnetic iron oxide powder.

Next, an aqueous solution containing ferrous sulfate is added in the amount of about one equivalent of the added amount of the previously added alkali to a slurry-like liquid containing the seed crystals. Air is blown in with the pH of the solution maintained at 5 to 10 as the ferrous hydroxide is reacted, to grow a magnetic iron oxide powder around the core of the seed crystals. The shape and magnetic properties of the magnetic powder can be controlled during this process by optionally selecting the pH, reaction temperature and stirring conditions. The pH of the solution becomes more acidic as the oxidation reaction progresses, but should preferably not fall below 5. The magnetic material thus obtained can then be filtered, washed and dried by conventional methods to obtain a magnetic powder.

When the toner is manufactured in an aqueous medium in the present invention, it is highly desirable to hydrophobically treat the surface of the magnetic powder. When surface treating by a dry process, the washed, filtered and dried magnetic powder is treated with a coupling agent. When surface treating by a wet process, the dried powder after completion of the oxidation reaction is re-dispersed, or else an iron oxide material obtained by washing and filtration after completion of the oxidation reaction is re-dispersed in another aqueous medium without being dried, and subjected to a coupling reaction. Either a dry process or a wet process may be selected appropriately in the present invention.

Examples of coupling agents that can be used in surface treating the magnetic powder include silane coupling agents, titanium coupling agents and the like. It is more desirable to use a silane coupling agent, which is represented by General Formula (I):

$$R_{\alpha}SiY_n \quad (I)$$

(in the formula, R represents a $C_{1-10}$ alkoxy group, m represents an integer from 1 to 3, Y represents a functional group such as an alkyl, phenyl, vinyl, epoxy or (meth)acrylic group, n represents an integer from 1 to 3, and m+n=4).

In the present invention, Y is preferably an alkyl group in General Formula (I). An alkyl group with at least 3 and not more than 6 carbon atoms, or preferably 3 or 4 carbon atoms, is preferred.

When the coupling agent is used, it may be used individually, or multiple types may be combined for treatment. When multiple types are combined, treatment may be performed separately with each coupling agent, or simultaneously with all at once.

The total amount of the coupling agent used in treatment is preferably 0.9 to 3.0 mass parts per 100 mass parts of the magnetic powder, and it is important to adjust the amount of the treatment agent according to the surface area of the magnetic powder and the reactivity of the coupling agent and the like.

When a magnetic powder is used in the present invention, another colorant may also be used. Colorants that can be used with the magnetic powder include the known dyes and pigments listed above, and magnetic or non-magnetic inorganic compounds. Specific examples include ferromagnetic metal particles of cobalt, nickel or the like, alloys obtained by adding chrome, manganese, copper, zinc, aluminum and rare earth elements and the like to these, particles of hematite and the like, titanium black, nigrosine dyes and pigments, and carbon black, phthalocyanine and the like. These may also be used after being surface treated.

The content of the magnetic powder in the toner can be measured with a TGA7 thermal analyzer (PerkinElmer Inc.). The measurement methods are as follows. The toner is heated from room temperature to 900° C. at a ramp rate of 25° C./minute in a nitrogen atmosphere. The percent of weight loss by mass between 100° C. and 750° C. is given as the amount of the binder resin, and the remaining mass as the approximate amount of the magnetic powder.

A charge control agent may also be included as necessary in the toner of the invention. A known charge control agent may be used, but preferred is a charge control agent that has a rapid triboelectric charging speed and can stably maintain a predetermined triboelectric charge quantity. When the toner particle is manufactured by a suspension polymerization method, moreover, the charge control agent should be one that interferes very little with polymerization, and has substantially no soluble material in the aqueous medium.

Some charge control agents give the toner a negative charge and some give it a positive charge. The following can give the toner a negative charge: monoazo metal compounds, acetylacetone metal compounds, metal compounds of aromatic oxycarboxylic acids, aromatic dicarboxylic acids, oxycarboxylic acids and dicarboxylic acids, aromatic oxycarboxylic acids, aromatic mono- and polycarboxylic acids and their metals salts, anhydrides and esters, phenols derivatives such as bisphenols, urea derivatives, metal-containing salicylic acid compounds, metal-containing naphthoic acid compounds, boron compounds, quaternary ammonium salts, calixarenes, and charge control resins.

Examples of positively charging charge control agents include the following: guanidine compounds; imidazole compounds; quaternary ammonium salts such as tributylbenzylammonium-1-hydroxy-4-naphthosulfonic acid salt and tetrabutylammonium tetrafluoroborate, analogs of these including onium salts such as phosphonium salts, and lake pigments of these; triphenylmethane dyes and lake pigments of these (in which the laking agent may be phosphotungstic acid, phosphomolybdic acid, phosphotungstenmolybdic acid, tannic acid, lauric acid or gallic acid, or a ferricyanide or ferrocyanide); metal salts of higher fatty acids; and charge control resins.

One of these charge control agents or a combination of two or more may be used.

Of these charge control agents, a metal-containing salicylic acid compound is preferred, especially one in which the metal is aluminum or zirconium.

The added amount of the charge control agent is preferably at least 0.01 mass parts and not more than 20.0 mass parts, or more preferably at least 0.5 mass parts and not more than 10.0 mass parts per 100.0 mass parts of the binder resin, A polymer or copolymer having a sulfonic acid group, sulfonate group or sulfonic acid ester group is desirable as a charge control resin. A sulfonic acid group-containing acrylamide monomer or sulfonic acid group-containing methacrylamide monomer is preferably contained at a copolymerization ratio of at least 2 mass % as a polymer having a sulfonic acid group, sulfonate group or sulfonic acid ester group. More preferably, it is contained at a copolymerization ratio of at least 5 mass %.

The charge control resin preferably has a glass transition temperature (Tg) of at least 35° C. and not more than 90° C., a peak molecular weight (Mp) of at least 10,000 and not more than 30,000, and a weight-average molecular weight (Mw) of at least 25,000 and not more than 50,000. Using this charge control resin, desirable triboelectric charging properties can be obtained without affecting the necessary thermal characteristics of the toner. Because the charge control resin contains a sulfonic acid group, moreover, the dispersibility of the charge control resin in a liquid dispersion of the colorant and the dispersibility of the colorant can be improved, and the tinting strength, transparency and triboelectric charging performance can be further improved.

The weight-average particle diameter (D4) of the toner is preferably at least 3.0 μm and not more than 12.0 μm, or more preferably at least 4.0 μm and not more than 10.0 Mm. If the weight-average particle diameter (D4) is at least 3.0 μm and not more than 12.0 μm, good flowability is obtained, and the latent image can be developed faithfully.

The toner of the invention can be manufactured by any known method. In the case of a pulverization method, for example a binder resin, colorant, releasing agent and crystalline polyester together with other additives and the like as necessary can be thoroughly mixed with a Henschel mixer, ball mill or other mixer. This can then be melt kneaded with a thermal kneading device such as a heat roller, kneader or extruder to disperse or melt the toner materials, which can then be cooled and solidified, pulverized, classified and optionally surface treated to obtain a toner particle. Either classification or surface treatment may be performed before the other. From the standpoint of productivity, a multi-grade classifier is preferred the classification step.

The pulverization step may be performed by a method using a known pulverization device, such as a mechanical impact device or jet pulverizer. It is also desirable to apply heat or additional mechanical impact during pulverization. It is also possible to use a hot water bath method of dispersing the finely pulverized (and optionally classified) toner particle in hot water, or a method of passing the particle through a hot air stream.

Methods of applying mechanical impact force include methods using the Kryptron system manufactured by Kawasaki industries, Ltd, or the Turbo Mill Heavy manufactured by Turbo Kogyo Co., Ltd. Mechanical impact force may also be applied to the toner by a device such as the Mechanofusion system manufactured by Hosokawa Micron Corporation, Ltd, or the Hybridization system manufactured by Nara Machinery Co., Ltd. that applies uses a high-speed rotating blade to press the toner by centrifugal force against the inside of a casing, to thereby apply mechanical impact force by means of compression, friction and the like.

The toner of the invention may be manufactured by a pulverization method such as that described above, or by an emulsion aggregation method. The toner is preferably manufactured in an aqueous medium in order to control the states of the crystalline polyester and releasing agent. A suspension polymerization method is especially desirable because it makes it easy to control the dispersion state of the crystalline polyester and form domains on the order of micrometers in size.

Suspension polymerization is explained below.

In suspension polymerization, a polymerizable monomer for forming a binder resin, a releasing agent, a crystalline polyester and a colorant (together with a polymerization initiator, crosslinking agent, charge control agent and other additives as necessary) are uniformly dissolved or dispersed to obtain a poly sizable monomer composition. This polymerizable monomer composition is then dispersed and granulated with a suitable stirrer in a continuous phase (such as a water phase) containing a dispersant, and a polymerization reaction is performed on the polymerizable monomer in the polymerizable monomer composition to obtain a toner having a desired particle diameter. Because the shapes of the individual toner particles are generally spherical in the toner obtained by this suspension polymerization method (hereunder called the "polymerized toner"), the charge quantity distribution is also relatively uniform, and improved image quality can be expected as a result.

The following are examples of polymerizable monomers constituting the polymerizable monomer composition when manufacturing the polymerized toner.

Examples of polymerizable monomers include styrene and styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chlorethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamide. These monomers may be used individually, or a mixture may be used. Of these monomers, it is desirable to use styrene either by itself or in combination with other monomers to improve the developing characteristics and durability.

The polymerization initiator used in suspension polymerization is preferably one with a half-life of 0.5 to 30 hours in the polymerization reaction. If the polymerization reaction is performed with an added amount of 0.5 to 20 mass parts per 100 mass parts of the polymerizable monomer, moreover, it is possible to obtain a polymer having a maximum molecular weight in the range of 5,000 to 50,000, which allows the toner to have the desired strength and suitable melting properties.

Specific examples of polymerization initiators include azo or diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide polymerization initiators such as benzoyl peroxide, methyl ethyl ketone peroxide, diisopropyl peroxycarbonate, di-sec-butyl peroxydicarbonate, cumene hydroperoxide, 2,4-dichlorobenzoyl peroxide, lauroyl peroxide, t-butyl peroxy-2-ethyl hexanoate and t-butyl peroxypivalate.

When the toner of the invention is manufactured by suspension polymerization, a crosslinking agent may also be added, in the amount of preferably 0.001 to 15 mass parts per 100 mass parts of the polymerizable monomer.

Compounds having two or more polymerizable double bonds are primarily used as crosslinking agents in the present invention, and examples include aromatic divinyl compounds such as divinyl benzene and divinyl naphthalene, carboxylic acid esters having two or more double bonds, such as ethylene glycol diacrylate, ethylene glycol dimethacrylate, 1,3-butanediol dimethacrylate, triethylene glycol diacrylate, tetraethylene glycol diacrylate, polyethylene glycol diacrylate, 1,4-butanediol diacrylate, 1,5-pentanediol diacrylate, 1,6-hexanediol diacrylate, 1,7-heptanediol diacrylate, 1,8-octanediol diacrylate, 1,9-nonanediol diacrylate, 1,10-decanediol diacrylate, 1,11-undecanediol diacrylate, 1,18-octadecanediol diacrylate, neopentylglycol diacrylate, tripropylene glycol diacrylate and polypropylene glycol diacrylate, divinyl compounds such as divinyl aniline, divinyl ether, divinyl sulfide and divinyl sulfone, and compounds having three or more vinyl groups, and these may be used independently or a mixture of two or more may be used.

1,4-butanediol diacrylate, 1,5-pentanediol diacrylate, 1,6-hexanediol diacrylate, 1,7-heptanediol diacrylate, 1,8-octanediol diacrylate, 1,9-nonanediol diacrylate, 1,10-decanediol diacrylate, 1,11-undecanediol diacrylate and 1,18-octadecanediol diacrylate, which are represented by the following formula, can be used by preference.

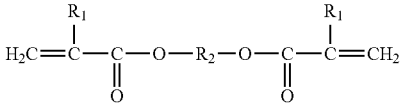

(In the formula, $R_1$ represents a hydrogen atom or alkyl group, and $R_2$ represents a $C_{4-18}$ linear alkylene group.)

These compounds have flexibility, and because the molecular chain is relatively long the gaps between the crosslinking points of the binder resin are likely to be wide, and a large network structure is likely to form.

This makes it easier to control the coverage ratio of the releasing agent by the crystalline polyester in the present invention, and address fixation peeling while achieving durable developing performance after long-term storage.

The reasons are not entirely clear, but it is thought that the fragility of the toner is reduced by giving it a crosslinking structure, while at the same time the states of the releasing agent and crystalline polyester are less likely to be affected due to the wide gaps between crosslinking points.

In suspension polymerization, in general suitable amounts of the toner composition described above and the like are added and uniformly dissolved or dispersed with a disperser such as a homogenizer, ball mill, ultrasound disperser or the like to obtain a polymerizable monomer composition which is suspended in an aqueous medium containing a dispersant. In this case, the particle size distribution of the resulting toner will be sharper if the desired toner particle size is obtained all at once with a high-speed dispersion apparatus such as a high-speed stirrer or ultrasound disperser. The polymerization initiator may be added to the polymerizable monomers at the same time as the other additives, or may be mixed into the aqueous medium immediately before suspension. The polymerization initiator may also be dissolved in the polymerizable monomer or in a solvent and added immediately after granulation and before the start of the polymerization reaction.

After granulation, stirring can be performed with an ordinary stirrer to an extent sufficient to maintain the particle state and prevent floating and precipitation of the particles.

A known surfactant or organic or inorganic dispersant may be used as the dispersant for manufacturing the toner of the invention. Of these, an inorganic dispersant can be used by preference because it is unlikely to produce harmful ultrafine powder, because the dispersion stability is obtained through steric hindrance and is thus unlikely to break down even if the reaction temperature is changed, and because the dispersant is easy to wash and unlikely to have an adverse effect on the toner. Examples of such inorganic dispersants include polyvalent metal phosphate salts such as tricalcium phosphate, magnesium phosphate, aluminum phosphate, zinc phosphate and hydroxyapatite, carbonate salts such as calcium carbonate and magnesium carbonate, inorganic salts such as calcium metasilicate, calcium sulfate and barium sulfate, and inorganic compounds such as calcium hydroxide, magnesium hydroxide and aluminum hydroxide.

These inorganic dispersants are preferably used in the amount of 0.2 to 20 mass parts per 100 mass parts of the polymerizable monomers. These dispersants may be used individually, or multiple kinds may be used together. They may also be combined with 0.001 to 0.1 mass parts of a surfactant.

When using such inorganic dispersants, they may be used as is, but particles of the inorganic dispersant may also be generated in an aqueous medium to obtain finer particles. In the case of tricalcium phosphate for example, a sodium phosphate aqueous solution and a calcium chloride aqueous solution can be mixed under high-speed stirring to produce water-insoluble calcium phosphate, allowing for more uniform fine dispersion. In this case water-soluble sodium chloride is produced at the same time as a by-product, but this is actually an advantage because when a water-soluble salt is present in an aqueous medium it suppresses dissolution of the polymerizable monomer in water, inhibiting the production of ultrafine toner powder by emulsion polymerization.

Examples of surfactants include sodium dodecylbenzene sulfate, sodium tetradecyl sulfate, sodium pentadecyl sulfate, sodium octyl sulfate, sodium oleate, sodium laurate, sodium stearate and potassium stearate.

In the step of polymerizing the polymerizable monomer, the polymerization temperature is set to at least 40° C., or commonly from 50° C. to 90° C. If polymerization is performed within this temperature range, the releasing agent (ester wax or the like) that should be sealed inside the toner is precipitated by phase separation, and becomes more completely enveloped.

When polymerization of the polymerizable monomer is complete and a colored particle has been obtained, the temperature can be raised to a temperature above the melting points of the crystalline polyester and releasing agent with the colored particle dispersed in an aqueous medium. This operation is not necessary if the polymerization temperature is above these melting points.

For the subsequent cooling conditions, the preferred range of conditions in the present invention applies not only to suspension polymerization but also to toner manufacturing methods in general.

Focusing on the toner manufacturing method with the aim of crystallizing the crystalline polyester, when the toner is manufactured by a pulverization method or by suspension polymerization or emulsion polymerization for example, often a step is included in which the temperature is first raised to a temperature that melts the crystalline polyester and releasing agent, and then cooled to room temperature. The cooling step is a desirable step for obtaining the toner of the invention because it is during cooling step that the crystalline polyester and releasing agent are crystallized.

Annealing at a temperature near the crystallization temperature of a crystalline substance (specifically, within ±5° C. of the crystallization temperature) is also desirable for increasing the degree of crystallization of the crystalline substance. The holding time is preferably in the range of at least 30 minutes, or more preferably at least 60 minutes, or still more preferably at least 100 minutes.

Holding the temperature for a long time is desirable for increasing the degree of crystallization of the crystalline polyester and releasing agent, and also for increasing the coverage ratio of the releasing agent by the crystalline polyester. If the holding time is short (such as less than 30 minutes), the crystallinity of the crystalline substance may not be increased sufficiently. In terms of the cooling rate, the crystal amount tends to increase when cooling is performed at a rate of at least 5.0° C./minute, and this is particularly desirable because it tends to increase the number of domains at least 5 nm and not more than 500 nm in size. More preferably the rate is at least 10.0° C./minute, or still more preferably at least 30.0° C./minute. A toner manufactured with the holding step and cooling rate controlled in this way is desirable because it tends to have superior peeling resistance and durable developing performance.

The resulting polymer particle is filtered, washed and dried by known methods to obtain a toner base particle. An inorganic fine powder may be mixed as necessary with this toner base particle as discussed below, and attached to the surface of the toner base particle. A classification step may also be included in the manufacturing process (before mixing with the inorganic fine powder) in order to remove coarse powder and fine powder contained in the toner particle.

An additive such as a fluidizing agent may also be mixed with a toner base particle obtained by such manufacturing methods. A known method may be used for mixing, and a Henschel mixer for example is desirable as the mixing apparatus.

The toner of the invention preferably has an inorganic fine powder with a number-average particle diameter of the primary particles of 4 to 80 nm or more preferably 6 to 40 nm added as a fluidizing agent. The inorganic fine powder is added to improve the flowability of the toner and uniformize the charge, and subjecting the inorganic fine particle to hydrophobic treatment or other treatment is desirable for adjusting the charge quantity of the toner and conferring such functions as improved environmental stability. The number-average particle diameter of the primary particles of the inorganic fine powder is measured using a photograph of the toner enlarged under a scanning electron microscope.

Silica, titanium oxide, alumina or the like may be used as the inorganic fine powder in the present invention. Both dry silica or fumed silica produced by vapor phase oxidation of a silicon halide and wet silica produced from water glass or the like can be used as the silica fine powder. However, a dry silica having few silanol groups on the surface or inside the silica fine powder and having little manufacturing residue such as $Na_2O$ or $SO_2^{2-}$ is preferred. In the case of dry silica, another metal halide such as aluminum chloride or titanium chloride may be used together with the silicon halide in the manufacturing process to obtain a composite fine powder of silica with another metal oxide, and this is also considered dry silica.

The added amount of the inorganic fine powder is preferably 0.1 to 3.0 mass parts per 100 mass parts of the toner base particle (particle before addition of the inorganic fine powder). A satisfactory effect is obtained if the added amount is at least 0.1 mass parts, while fixing performance is good if it is not more than 3.0 mass parts. The content of the inorganic fine powder can be measured by fluorescent X-ray analysis using a calibration curve prepared using standard samples. The inorganic fine powder is preferably one that has been hydrophobically treated because this helps to improve the environmental stability of the toner. If the inorganic fine powder added to the toner absorbs moisture, the charge quantity of the toner particle declines dramatically, the charge quantity tends to be uneven, and toner scattering is likely. An organic titanium compound or an organic silicon compound such as silicone varnish, various kinds of modified silicone varnish, silicone oil, various kinds of modified silicone oil, silane compounds and silane coupling agents can be used as the treatment agent in hydrophobic treatment of the inorganic fine particle, and these may be used individually or two or more may be combined.

A small amount of another additive, such as for example a lubricating powder such as fluorine resin powder, zinc stearate powder or polyvinylidene fluoride powder; an abrasive such as cerium oxide powder, silicon carbide powder or strontium titanate powder; a flowability-imparting agent such as titanium oxide powder or aluminum oxide powder; a caking prevention agent; or a developing performance enhancer such as inorganic fine particles and organic fine particles of opposite polarity, may be used in the toner of the invention to the extent that it does not have an substantial adverse effect on the toner. The surfaces of these additives may also be hydrophobically treated before use.

An example of an image-forming apparatus that can be used favorably with the toner of the invention is explained next in detail with reference to FIG. 1. In FIG. 1, 100 is a photosensitive drum, and primary charging roller 117, developing device 140 having developing sleeve 102, transfer charging roller 114, cleaner 116, and register roller 124 and the like are disposed around this drum. Photosensitive drum 100 is charged to −600 V for example by primary charging roller 117 (with an applied voltage of 1.85 kVpp (AC) or −620 Vdc (DC) for example).

The photosensitive drum 100 is then exposed to laser light 123 from laser generator 121, forming an electrostatic latent image corresponding to the target image. The electrostatic latent image on the photosensitive drum 100 is developed with a one-component toner by developing device 140 to obtain a toner image, which is then transferred to a transfer material by transfer roller 114, which contacts the photosensitive member with the transfer material between the two. The transfer material carrying the toner image is transported to fixing unit 126 by transport belt 125 or the like, and the image is fixed on the transfer material. Any toner remaining on the photosensitive member is cleaned by cleaner 116.

An image forming apparatus using magnetic one-component jumping development is shown here, but either jumping development or contact development may be used.

The methods for measuring the various physical properties of the toner of the invention are explained next.

(Melting Point of Crystalline Polyester)

The melting point of the crystalline polyester can be determined by finding the peak top temperature of the endothermic peak in DSC measurement. Measurement is performed in accordance with ASTM D 3417-99. A DSC-7 (PerkinElmer Inc.), DSC2920 or Q1000 (TA Instruments) may be used for these measurements. The meltingpoints of indium and zinc are used for temperature correction of the device detection part, and the heat of fusion of indium is used for correction of the calorific value. The measurement sample is held in an aluminum pan, and measured using an empty pan for reference. Crystalline means that there is a clear endothermic peak in differential scanning calorimetry (DSC).

(Measuring Weight-Average Particle Diameter (D4) of Toner (Base Particle))

The weight-average particle diameter (D4) of the toner (base particle) is measured with 25,000 effective measurement channels using a precision particle size measurement device (Coulter Counter Multisizer® 3, Beckman Coulter, Inc.) based on the pore electrical resistance method and equipped with a 100 μm aperture tube, together with the accessory dedicated software (Coulter Counter Multisizer 3 Version 3.51, Beckman Coulter, Inc.) for setting measurement conditions and analyzing the measurement data, and the measurement data are analyzed to calculate the diameter.

The aqueous electrolytic solution used for measurement may be a solution of special-grade sodium chloride dissolved in ion-exchange water to a concentration of about 1 mass %, such as Isoton II (Beckman Coulter, Inc.).

The dedicated software settings are performed as follows prior to measurement and analysis.

On the "Change Standard Operating Method (SOM)" screen of the dedicated software, the total count number in control mode is set at 50,000 particles, the number of measurements is set at 1, and the kid value is set at a value obtained using "standard particle 1.0.0 μm" (Beckman Coulter, Inc.). The threshold/noise level measurement button is pressed to automatically set the threshold and noise level. The current is set to 1,600 μA, the gain to 2, and the electrolyte solution to isoton II. Flush of the aperture tube after measurement is checked.

On the "Conversion Setting from Pulse to Particle Diameter" screen of the dedicated software, the bin interval is set at the logarithmic particle diameter, the particle diameter bin is set at the 256 particle diameter bin, and the range of particle diameters is set to at least 2 μm and not more than 60 μm.

The specific measurement methods are as follows.

(1) About 200 mL of the aqueous electrolytic solution is placed in a glass 250 mL round-bottom beaker dedicated to the Multisizer 3, set on a sample stand, and stirred with a stirrer rod counterclockwise at a rate of 24 rotations/second. Contamination and bubbles in the aperture tube are removed by means of the "Aperture flush" function of the analytical software.

(2) Approximately 30 mL of the aqueous electrolytic solution is placed in a glass 100 mL flat-bottom beaker, and approximately 0.3 mL of a diluted solution of "Contaminon N" (a 10 mass % aqueous solution of a pH 7 neutral detergent for washing precision measurement equipment, made of a nonionic surfactant, an anionic surfactant and an organic builder, made by Wako Pure Chemical Industries, Ltd.) diluted 3 times by mass with ion exchange water is added thereto as a dispersant.

(3) A predetermined amount of ion-exchange water is placed in a water bath of an ultrasonic disperser "Ultrasonic Dispersion System Tetora 150" (Nikkaki Bios Co., Ltd.) with an electric output of 120 W, in which two oscillators with an oscillation frequency of 50 kHz are built-in with the phases of the oscillators shifted by 180° to one other. About 2 mL of the Contaminon N is added to the water bath.

(4) The beaker of (2) is set in a beaker fixing hole of the ultrasonic disperser, and the ultrasonic disperser is operated. The height position of the beaker is adjusted so as to maximize the resonance state of the surface of the aqueous electrolytic solution in the beaker.

(5) With the aqueous electrolytic solution in the beaker of (4) exposed to ultrasound waves, approximately 10 mg of the toner (base particle) is added to the aqueous electrolytic solution little by little, and dispersed. Further, the ultrasonic dispersion is continued for 60 seconds. During ultrasonic dispersion, the temperature of the water in the water bath is properly adjusted so as to be at least 10° C. and not more than 40° C.

(6) Using a pipette, the aqueous electrolytic solution of (5) with the toner (base particle) dispersed therein is added dropwise to the round-bottom beaker of (1) disposed on the sample stand, and the measurement concentration is adjusted so as to be approximately 5%. Measurement is then performed until the number of measured particles reaches 50,000.

(7) The measurement data is analyzed with the dedicated software attached to the apparatus, and the weight-average particle diameter (D4) is calculated. The weight-average particle diameter (D4) is the "average diameter" on the "Analysis/volume Statistical Value (arithmetic average)" screen when graph/vol % is set by the dedicated software.

(Method for Measuring Molecular Weight of Crystalline Polyester, Etc.)

The molecular weights of the crystalline polyester, amorphous saturated polyester resin and toner are measured as follows by gel permeation chromatography (GPC).

First, the crystalline polyester, amorphous saturated polyester resin or toner is dissolved in tetrahydrofuran (THF). The resulting solution is then filtered with a 0.2 μm pore diameter solvent-resistant membrane filter (Sample Pretreatment Cartridge, Tosoh Corporation) to obtain a sample solution. The concentration of THF-soluble components in the sample solution is adjusted to 0.8 mass %. Measurement is performed under the following conditions using this sample solution.

Apparatus: High-speed GPC unit "HLC-8220 GPC" (Tosoh Corporation)

Columns: LF-604 (2 columns)

Eluent: THF

Flow rate: 0.6 mL/min

Oven temperature: 40° C.

Sample injection volume: 0.020 mL.

A molecular weight calibration curve prepared using standard polystyrene resin (for example, TSK™ Standard Polystyrene F-850, F-450, F-288, F-128, F-80, F-40, F-20, F-10, F-4, F-2, F-1, A-5000, A-2500, A-1000, A-500, Tosoh Corporation) was used for calculating the molecular weight of the samples.

(Method for Measuring Acid Value of Crystalline Polyester)

The acid value is the number of mg of potassium hydroxide needed to neutralize the acid contained in 1 g of sample. The acid value of the crystalline polyester was measured in accordance with JIS K 0070-1992. Specifically, it was measured by the following procedures.

(1) Sample preparation 1.0 g of phenolphthalein was dissolved in 90 mL of ethyl alcohol (95 vol %), and ion-exchange water was added to a total of 100 mL to obtain a phenolphthalein solution.

7 g of special-grade potassium hydroxide was dissolved in 5 mL of water, and ethyl alcohol (95 vol %) was added to a total of 1 L. Taking care to avoid contact with carbon dioxide and the like, this was placed in an alkali resistant container, left standing for 3 days, and filtered to obtain a potassium hydroxide solution. The resulting potassium hydroxide solution was stored in an alkali-resistant container. The factor of the potassium hydroxide solution was obtained by placing 25 mL of 0.1 mol/L hydrochloric acid in a triangular flask, adding several drops of the phenolphthalein solution, titrating this with the potassium hydroxide solution, and determining the amount of the potassium hydroxide solution required for neutralization. The 0.1 mol/L hydrochloric acid was prepared in accordance with JIS K 8001-1998.

(2) Operations (A) Main test 2.0 g of pulverized crystalline polyester sample was weighed precisely into a 200 mL triangular flask, 100 mL of a toluene/ethanol (2:1) mixed solution was added, and the sample was dissolved over the course of 5 hours. Several drops of the phenolphthalein solution were then added as an indicator, and this was then titrated with the potassium hydroxide solution. Titration was considered to be complete when the light pink color of the indicator persisted for 30 seconds.

(B) Blank Test

Titration was performed by the same operations but without a sample (using only a mixed toluene/ethanol (2:1) solution).

(3) The Test Results were Entered into the Following Formula to Calculate the Acid Value.

$$A=[(C-B)\times f\times 5.61]/S$$

In the formula, A is the acid value (mg KOH/g), B is the added amount (mL) of the potassium hydroxide solution in the blank test, C is the added amount (mL) of the potassium hydroxide solution in the main test, f is the factor of the potassium hydroxide solution, and S is the sample (g).

(Method for Measuring Hydroxyl Value of Crystalline Polyester)

In the present invention the hydroxyl value OHv of the crystalline polyester (JIS hydroxyl value) is determined by the following methods. The hydroxyl value is the number of mg of potassium hydroxide needed to neutralize the acetic acid bound to hydroxyl groups when acetylating 1 g of sample. The hydroxyl value of the crystalline polyester is measured in accordance with JIS K 0070-1992.

Specifically, it is measured by the following procedures.

(a) Sample Preparation 25 mg of special-grade acetic anhydride is placed in a 100 mL measuring flask, and pyridine is added to a total of 100 mL, and thoroughly stirred to obtain an acetylation reagent. The resulting acetylation reagent is stored in a brown bottle so as to avoid contact with moisture, carbon dioxide and the like. 1.0 g of phenolphthalein is dissolved in 90 mL of ethyl alcohol (95 vol %), and ion-exchange water is added to a total of 100 mL to obtain a phenolphthalein solution. 35 g of special-grade potassium hydroxide is dissolved in 20 mL of water, and ethyl alcohol (95 vol %) is added to a total of 1 L. Taking care to avoid contact with carbon dioxide and the like, this is placed in an alkali resistant container, left standing for 3 days, and filtered to obtain a potassium hydroxide solution. The resulting potassium hydroxide solution is stored in an alkali-resistant container. The factor of the potassium hydroxide solution was obtained by placing 25 mL of 0.5 mol/L hydrochloric acid in a triangular flask, adding several drops of the phenolphthalein solution, titrating this with the potassium hydroxide solution, and determining the amount of the potassium hydroxide solution required for neutralization.

(b) Operations (A) Main Test 1.0 g of pulverized crystalline polyester sample is weighed precisely into a 200 mL round-bottom flask, and 5.0 mL of the acetylation reagent is then added accurately with a Hall pipette. If the sample is hard to dissolve in the acetylation reagent, a small amount of special-grade toluene is added to dissolve it.

A small funnel is placed in the mouth of the flask, and about 1 cm of the flask bottom is heated by immersing it in a roughly 97° C. glycerin bath. To prevent the temperature of the neck of the flask from rising due to the heat of the bath, the base of the neck is preferably covered with a thick paper having a round hole.

One hour later, the flask is removed from the glycerin bath and cooled. After cooling, 1 mL of water is added through the funnel, and the mixture is shaken to hydrolyze the acetic anhydride. The flask is then heated again for 10 minutes in the glycerin bath to achieve complete hydrolysis. After cooling, the walls of the funnel and flask are washed with 5 mL of ethyl alcohol.

Several drops of the phenolphthalein solution are added as an indicator, and titration is performed with the potassium hydroxide solution. Titration is considered complete when the light pink color of the indicator persisted for 30 seconds.

(B) Blank Test

Titration is performed by the same operations but without a sample.

(c) The test results are entered into the following formula to calculate the hydroxyl value.

$$A=[\{(B-C)\times 28.05\times f\}/S]+D$$

In the formula, A is the hydroxyl value (mg KOH/g), B is the added amount (mL) of the potassium hydroxide in the blank test, C is the added amount (mL) of the potassium hydroxide solution in the main test, f is the factor of the potassium hydroxide solution, S is the sample (g), and D is the acid value (mg KOH/g) of the crystalline polyester.

(Method for Observing Toner Particle Cross-Section by Transmission Electron Microscopy (TEM) with Ruthenium Staining)

A cross-section of the toner particle can be observed as follows by transmission electron microscopy (TEM).

The toner particle cross-section is ruthenium stained for purposes of observation. Because they are crystalline, the crystalline polyester and releasing agent contained in the toner are stained more with ruthenium than amorphous resins like the binder resin. Consequently, the contrast is clear and observation is easy. Because the quantity of ruthenium atoms differs depending on the strength of staining, more atoms are present in the strongly stained parts of the cross-section, which appear black in the observed image because the electron beam does not pass through, while the weakly stained parts appear white because the electron beam passes through readily.

First, the toner is spread as a single layer on a cover glass (Matsunami Glass Ind., Ltd., square cover glass No. 1), and an Os film (5 nm) and naphthalene film (20 nm) are applied as protective films to the toner particles with an Osmium Plasma Coater (Filgen, Inc., OPC80T). A PTFE tube (ϕ1.5 mm×ϕ3 mm×3 mm) is filled with D800 photocurable resin (JEOL Ltd.), and the previous cover glass is gently placed over the tube so that the toner particles contact the D800 photocurable resin. This is then exposed to light to cure the resin, and the cover glass and tube are removed to form a resin cylinder containing embedded toner particles in the outermost surface. This is then cut at a cutting speed of 0.6 mm/s with an Ultramicrotome (Leica Microsystems GmbH, UC7) only to a length equal to the toner radius (4.0 μm when the weight-average particle diameter (D4) is 8.0 μm) from the outermost surface of the resin cylinder, to give a toner particle cross-section. This is then cut to a film thickness of 250 nm, to prepare a thin sample of the toner particle cross-section. A cross-section of the central part of the toner particle can be obtained by cutting in this manner.

The resulting thin sample is stained for 15 minutes in a 500 Pa $RuO_4$ gas atmosphere with a vacuum electron staining unit (Filgen, Inc., VSC4R1H), and observed by STEM using the STEM function of a TEM (JEOL Ltd., JEM2800).

The STEM probe size was 1 nm, and an image size of 1024×1024 pixels was adopted. An image was obtained with the Contrast adjusted to 1425 and the Brightness to 3750 in the bright field image Detector Control panel, and the Contrast adjusted to 0.0, the Brightness to 0.5 and Gamma to 1.00 in the Image Control panel.

(Identifying Crystalline Polyester and Releasing Agent Domains)

The crystalline polyester domains were identified as follows based on a TEM image of a toner particle cross-section.

When the crystalline materials can be obtained as raw materials, their crystal structures can be observed by transmission electron microscopy (TEM) in the same way as the ruthenium stained toner particle cross-section described above, to obtain images of the crystal lamellar structures of each raw material. These are then compared with the lamellar structures of the domains in the toner particle cross-section, and when the lamellar layer spacing has an error of 10% or less, the raw materials forming the domains in the toner particle cross-section can be specified.

(Measuring Maximum Diameter of Releasing Agent Domains)

To measure the domain diameter of the releasing agent, a ruthenium stained toner particle cross-section is observed by transmission electron microscopy (TEM) to obtain a TEM image, and the maximum diameter of the domain with the largest area out of the releasing agent domains is measured.

Cross-sections of 100 toner particles are observed, and the arithmetic mean is given as the maximum diameter of the releasing agent domains.

The toner particles chosen for observation are those exhibiting a longitudinal diameter R (μm) that satisfies the following relationship with respect to the weight-average particle diameter (D4): $0.9 \leq R/D \leq 1.1$.

(Measuring Numbers of Domains of Crystalline Polyester and Releasing Agent)

The numbers of crystalline polyester domains and releasing agent domains contained in the toner particle cross-section of one particle are counted using a TEM image like that used to measure the diameters of the crystalline polyester and releasing agent domains. Specifically, the numbers of domains with a maximum diameter of 5 to 500 nm are counted. This is done for cross-sections of 100 toner particles, and the numbers of domains per individual toner particle cross-section are given as the numbers of domains of the crystalline polyester and releasing agent.

(Measuring Percentage of Toner Particles in which Crystalline Polyester Domains and Releasing Agent Domains are Observed in the Same Individual Particle (Tcw))

When identifying the crystalline polyester and releasing agent domains as described above, the number of toner particles having both crystalline polyester domains and releasing agent domains is counted in 100 toner particles fulfilling the requirement of $0.9 \leq R/D4 \leq 1.1$, and calculated as a percentage of the toner.

(Measuring Average Coverage Ratio of Releasing Agent Domains by Crystalline Polyester)

The coverage ratio is calculated as follows using TEM images of toner particle cross-sections from the particle group formed of toner particles (Tcw) containing both domains of the crystalline polyester and domains of the releasing agent in the same individual particle. A releasing agent domain having the maximum diameter is first specified in TEM observation, and a perimeter (L1) is measured free hand around the border of this domain. The length (L2) of the part of this releasing agent domain that contacts the crystalline polyester is then also measured free hand. The coverage ratio can then be calculated from the following formula using these values.

$$\text{Coverage ratio (\%)} = L2/L1 \times 100$$

The same calculation is performed on 100 toner particles that satisfy the formula $0.9 \leq R/D \leq 1.1$, and the arithmetic mean is taken as the average coverage ratio of the releasing agent domains by the crystalline polyester.

(Measuring Area Ratios of Crystalline Polyester Domains and Releasing Agent Domains Relative to Cross-Sectional Area of Toner Particle)

To measure the area ratios of the crystalline polyester domains and releasing agent domains relative to the cross-sectional area of the toner particle, images (bright field images) obtained by TEM observation performed as above on a particle group formed of Tcw toner particles are binarized with Image J 1.48 image processing software.

Binarization is performed with the brightness threshold (gradation 255) set so that the domains of the releasing agent and crystalline polyester can be distinguished, and the areas of the domains are determined. The area of each toner particle cross-section having these domains is also determined, and the area ratio is determined by dividing the values.

Binarization is performed on 100 toner particles satisfying the formula $0.9 \leq R/D4 \leq 1.1$, the results are quantified, and the average value is taken as the area ratio.

(Identifying Terminal Structure of Crystalline Polyester)

2 mg of a resin sample is weighed precisely, and 2 mL of chloroform is added to dissolve the sample and prepare a sample solution. The crystalline polyester is used for the resin sample, but a sample of toner containing the crystalline polyester may be used instead. Next, 20 mg of 2,5-dihydroxybenzoic acid (DHBA) is weighed precisely, and 1 mL of chloroform is added to dissolve the DHBA and prepare a matrix solution. 3 mg of sodium trifluoroacetate (NaTFA) is also weighed precisely, and 1 mL of acetone is added to dissolve the NaTFA and prepare an ionizing aid solution.

25 μL of the sample solution, 50 μL of the matrix solution and 5 μL of the ionizing aid solution thus prepared are mixed, dripped onto a sample plate for MALDI analysis, and dried to obtain a measurement sample. A mass spectrum is obtained using MALDI-TOFMS (Reflex III, Bruker Daltonics) as the analysis equipment. In the resulting mass spectrum, each peak in the oligomer range (m/Z 2000 or less) is attributed, and the presence or absence of a peak corresponding to the structure of a monocarboxylic acid bound to the molecular terminal is confirmed.

EXAMPLES

The present invention is explained in detail below using examples and comparative examples, but these do not limit the present invention. Parts in the following formulations are all parts by mass.

(Manufacture of Crystalline Polyesters 1 to 13)

Crystalline polyesters 1 to 13 were obtained using the alcohol monomers and carboxylic acid monomers 1 and 2 shown in Table 1, with the reaction times and temperatures and the added amounts of the monomers adjusted so as to obtain the desired physical properties. The physical properties of the crystalline polyesters are shown in Table 1. Crystalline polyesters 1 to 13 all exhibit clear endothermic peaks in differential scanning calorimetry (DSC).

TABLE 1

| | Monomers | | | Physical properties of crystalline polyester | | | |
|---|---|---|---|---|---|---|---|
| | Alcohol monomer | Carboxylic acid monomer 1 | Carboxylic acid monomer 2 | Mw | Melting point (° C.) | Acid value | Hydroxyl value |
| Crystalline polyester 1 | 1,9-nonanediol | Decanedioic acid (sebacic acid) | Stearic acid | 38000 | 70 | 2 | 5.5 |
| Crystalline polyester 2 | 1,6-hexanediol | Hexanedioic acid (adipic acid) | Stearic acid | 45000 | 58 | 1.5 | 3.5 |
| Crystalline polyester 3 | 1,10-decanediol | Decanedioic acid (sebacic acid) | Lauric acid | 25500 | 72 | 2.2 | 5.4 |
| Crystalline polyester 4 | 1,12-dodecanediol | Decanedioic acid (sebacic acid) | Behenic acid | 25000 | 79 | 2.1 | 5.3 |
| Crystalline polyester 5 | 1,16-hexadecanediol | Decanedioic acid (sebacic acid) | Stearic acid | 44500 | 64 | 1.2 | 3.3 |
| Crystalline polyester 6 | 1,12-dodecanediol | Decanedioic acid (sebacic acid) | Stearic acid | 35000 | 79 | 1.7 | 5.5 |
| Crystalline polyester 7 | 1,6-hexanediol | Decanedioic acid (sebacic acid) | Caproic acid | 34200 | 67 | 3.3 | 5.4 |
| Crystalline polyester 8 | 1,6-hexanediol | Hexadecanedicarboxylic acid | Lignoceric acid | 33000 | 81 | 2.3 | 5.3 |
| Crystalline polyester 9 | 1,12-dodecanediol | Butanedioic acid (succinic acid) | Stearic acid | 38000 | 67 | 2.3 | 5 |
| Crystalline polyester 10 | 1,6-hexanediol | Octadecanedicarboxylic acid | Lignoceric acid | 19200 | 90 | 4 | 6.8 |
| Crystalline polyester 11 | 1,4-butanediol | Decanedioic acid (sebacic acid) | Lignoceric acid | 16000 | 65 | 4.5 | 7.2 |
| Crystalline polyester 12 | 1,18-octandecanediol | Decanedioic acid (sebacic acid) | — | 16000 | 102 | 5 | 38.3 |
| Crystalline polyester 13 | 1,10-decanediol | Decanedioic acid (sebacic acid) | — | 55000 | 76 | 1.1 | 25.2 |
| Crystalline polyester 14 | 1,6-hexanediol | Hexanedioic acid (adipic acid) | Stearic acid | 12000 | 43 | 5.3 | 5.5 |
| Crystalline polyester 15 | 1,6-hexanediol | Hexanedioic acid (adipic acid) | Stearic acid | 12500 | 43 | 5.4 | 5.7 |

(Manufacturing Example of Magnetic Iron Oxide)

55 liters of a 4.0 mol/L sodium hydroxide aqueous solution were mixed and stirred into 50 liters of a ferrous sulfate aqueous solution containing 2.0 mol/L of $Fe^{2+}$, to obtain a ferrous salt aqueous solution containing a ferrous hydroxide colloid. This aqueous solution was maintained at 85° C. as air was blown in at 20 L/min to perform an oxidation reaction and obtain a slurry containing a core particle.

The resulting slurry was filtered and washed in a filter press, and the core particle was re-dispersed in water to obtain a reslurry. Sodium silicate having a concentration of 0.20 mass % as silicon per 100 parts of the core particle was added to this reslurry, such that the pH of the slurry was adjusted to 6.0, and the slurry was stirred to obtain a magnetic iron oxide particle having a silicon-rich surface. The resulting slurry was filtered and washed in a filter press, and reslurried again with ion-exchange water. 500 g (10 mass % of magnetic iron oxide) of SK110 (Mitsubishi Chemical Corporation) ion-exchange resin was added to this reslurry (solids 50 g/L), and stirred for 2 hours to perform ion exchange. The ion-exchange resin was then filtered out with a mesh, and the remainder was filtered and washed with a filter press and then dried and crushed to obtain a magnetic iron oxide with a number-average diameter of 0.23 μm.

(Manufacture of Silane Compound)

30 parts of iso-butyl trimethoxysilane were added dropwise with stirring to 70 parts of ion-exchange water. This aqueous solution was maintained at pH 5.5, 55° C., and dispersed and hydrolyzed for 120 minutes at a peripheral velocity of 0.46 m/s with a disperser blade. The pH of the aqueous solution was then raised to 7.0, and the mixture was cooled to 10° C. to stop the hydrolytic reaction and obtain an aqueous solution containing a silane compound.

(Manufacture of Magnetic Material 1)

100 parts of the magnetic iron oxide was placed in a high speed mixer (LFS-2, Fukae Powtec Co, Ltd.) and stirred at 2,000 rpm as 8.0 parts of the aqueous solution containing a silane compound were added dropwise over the course of 2 minutes. This was then mixed and stirred for 5 minutes. To increase the adhesiveness of the silane compound, this was then dried for 1 hour at 40° C. to reduce the water content, and the mixture was then dried for 3 hours at 110° C. to promote a condensation reaction of the silane compound. This was then crushed and passed through a 100 μm mesh sieve to obtain a magnetic material 1.

(Manufacture of Toner Base Particle 1)

450 parts of a $Na_3PO_4$ aqueous solution (0.1 mol/L) were added to 720 parts of ion-exchange water, and heated to 60° C. 67.7 mass parts of a $CaCl_2$ aqueous solution (1.0 mol/L) were then added, and stirred at 1,200 r/min with a Clearmix (M Technique Co., Ltd.) to prepare an aqueous medium. 1,6-hexanediol diacrylate was used as a crosslinking agent.

| | |
|---|---|
| Styrene | 79.0 parts |
| n-butyl acrylate | 21.0 parts |
| 1,6-hexanediol diacrylate | 0.65 parts |
| Iron complex of monoazo dye (T-77; Hodogaya Chemical Co., Ltd.) | 1.5 parts |
| Magnetic material 1 | 95.0 parts |
| Amorphous saturated polyester resin | 5.0 parts |

(amorphous saturated polyester resin obtained by condensation reaction of bisphenol A ethylene oxide (2-mol) and propylene oxide (2-mol) adducts with terephthalic acid; Mw=9500, acid value=2.2 mg KOH/g, glass transition temperature=68° C.)

This formulation was uniformly dispersed and mixed with an attritor (Mitsui Miike Chemical Engineering Machinery, Co., Ltd.) to obtain a monomer composition. This monomer composition was heated to 63° C., and 10.0 mass parts of the crystalline polyester 1 shown in Table 3, 5.0 mass parts of dibehenyl sebacate as a releasing agent and 15.0 mass parts of HNP-9 (Nippon Seiro Co., Ltd.) were mixed in and dissolved.

The monomer composition was added to the previous aqueous medium, and stirred and granulated for 10 minutes at 12,000 rpm with a T.K. Homomixer (Tokushu Kika Kogyo Co., Ltd.) at 60° C. in an $N_2$ atmosphere. This was then stirred with a paddle stirrer as 5.0 mass parts of t-butyl peroxypivalate were added as the polymerization initiator, and then heated to 70° C. and reacted for 4 hours. After completion of the reaction, the suspension was heated to 100° C., and maintained for 2 hours.

(Cooling Step)

For the subsequent cooling step, room temperature water was added to the suspension, which was then cooled from 100° C. to 50° C. at a rate of 40° C./minute, maintained at 50° C. for 100 minutes, and then cooled to room temperature (a temperature of not more than 30° C. is considered room temperature for purposes of toner manufacture). The crystallization temperature of the crystalline polyester 1 was 53° C. Hydrochloric acid was then added to the suspension, which was thoroughly washed to dissolve the dispersion stabilizer, and filtered and dried to obtain a toner base particle 1. The formulation is shown in Table 2.

(Manufacture of Toner Base Particles 2 to 12)

Toner base particles 2 to 12 were manufactured in the same way as the toner base particle 1 except that the types and numbers of parts of the crystalline polyester and releasing agent and the cooling process were changed as shown in Table 2.

(Manufacture of Toner Base Particles 13 to 16)

Toner base particles 13 to 16 were manufactured in the same way as the toner base particle 1 except that the types and numbers of parts of the crystalline polyester and releasing agent and the cooling process were changed as shown in Table 2, and the added amount of the amorphous saturated polyester was changed to 30.0 parts.

(Manufacture of Comparative Toner Base Particles 1 to 6)

Comparative toner base particles 1 to 6 were manufactured in the same way as the toner base particle 1 except that the types and numbers of parts of the crystalline polyester and releasing agent and the cooling process were changed as shown in Table 2, and divinyl benzene was substituted as the crosslinking agent.

Toner base particles 1 to 16 and comparative toner base particles 1 to 6 all had glass transition temperatures in the range of 50° C. to 60° C., and weight-average particle diameters (D4) in the range of 6.5 to 9.0 μm.

The "cooling speed" in Table 2 is discussed here.

As in the manufacturing example of toner base particle 1, conditions of "40° C./minute" mean that in the cooling process, the suspension is first cooled at a rate of 40° C./minute from 100° C. to near the crystallization temperature of the crystalline polyester, held at that temperature for 100 minutes, and then cooled to room temperature. The crystallization temperature of the crystalline polyester is verified in advance to determine the end temperature and holding temperature of the cooling process. Similarly, conditions of "5° C./minute" and "1° C./minute" mean that in the cooling process, the suspension is first cooled at a rate of 5° C./minute or 1° C./minute from 100° C. to near the crystallization temperature of the crystalline polyester, with the subsequent holding temperature and cooling being the same.

(Manufacture of Toners 1 to 16 and Comparative Toners 1 to 6)

100 mass parts of the toner base particle 1 and 0.8 mass parts of a hydrophobic silica fine powder obtained by hexamethyldisilazane treating a dry silica fine particle with a BET value of 300 $m^2/g$ and a primary particle diameter of 8 nm were mixed in a Mitsui Henschel mixer (Mitsui Miike Chemical Engineering Machinery, Co., Ltd.) to obtain a toner 1.

Toners 2 to 16 and comparative toners 1 to 6 were obtained in the same way except that the toner base particles 2 to 16 and the comparative toner base particles 1 to 6 were substituted for the toner base particle 1.

TABLE 2

| Toner No. | Toner particle No. | Crystalline polyester No. | Crystalline polyester Added amount/parts | Hydrocarbon wax Type of hydrocarbon wax | Hydrocarbon wax Added amount/parts | Ester wax Type of ester wax | Ester wax Added amount/parts | Crystalline polyester/releasing agent mass ratio | Cooling speed |
|---|---|---|---|---|---|---|---|---|---|
| 1 | 1 | 1 | 10.0 | HNP9 | 15.0 | Dibehenyl sebacate | 5.0 | 0.50 | 40° C./min |
| 2 | 2 | 1 | 10.0 | HNP9 | 15.0 | Pentaerythritol tetrabehenate | 5.0 | 0.50 | 40° C./min |
| 3 | 3 | 2 | 10.0 | HNP9 | 15.0 | Dipentaerythritol hexabehenate | 5.0 | 0.50 | 40° C./min |
| 4 | 4 | 3 | 20.0 | HNP9 | 10.0 | Dibehenyl sebacate | 20.0 | 1.00 | 40° C./min |
| 5 | 5 | 4 | 5.0 | HNP9 | 10.0 | Dibehenyl sebacate | 10.0 | 0.25 | 40° C./min |
| 6 | 6 | 5 | 4.0 | HNP9 | 2.0 | Dibehenyl sebacate | 1.0 | 1.33 | 30° C./min |
| 7 | 7 | 6 | 30.0 | HNP9 | 4.5 | Dibehenyl sebacate | 3.0 | 4.00 | 30° C./min |
| 8 | 8 | 7 | 4.0 | HNP9 | 2.0 | Dibehenyl sebacate | 1.0 | 1.33 | 10° C./min |
| 9 | 9 | 8 | 10.0 | HNP9 | 15.0 | Dibehenyl sebacate | 5.0 | 0.50 | 10° C./min |
| 10 | 10 | 9 | 5.0 | HNP9 | 15.0 | Dibehenyl sebacate | 3.0 | 1.00 | 5° C./min |
| 11 | 11 | 9 | 4.0 | HNP9 | 10.0 | Dibehenyl sebacate | 10.0 | 0.20 | 5° C./min |
| 12 | 12 | 10 | 3.0 | HNP9 | 15.0 | Dibehenyl sebacate | 15.0 | 0.10 | 5° C./min |
| 13 | 13 | 11 | 4.0 | HNP9 | 10.0 | Dibehenyl sebacate | 10.0 | 0.20 | 5° C./min |
| 14 | 14 | 11 | 4.0 | HNP9 | 32.0 | — | 0.0 | 0.13 | 5° C./min |
| 15 | 15 | 11 | 4.0 | HNP9 | 32.0 | — | 0.0 | 0.13 | 1° C./min |
| 16 | 16 | 11 | 4.0 | HNP9 | 32.0 | — | 0.0 | 0.13 | 1° C./min |
| Comparative 1 | Comparative 1 | 12 | 10.0 | HNP9 | 15.0 | Dibehenyl sebacate | 5.0 | 0.50 | 1° C./min |
| Comparative 2 | Comparative 2 | 13 | 10.0 | HNP9 | 15.0 | — | 0.0 | 0.67 | 1° C./min |
| Comparative 3 | Comparative 3 | 1 | 10.0 | HNP9 | 1.0 | — | 0.0 | 10.00 | 5° C./min |
| Comparative 4 | Comparative 4 | 1 | 10.0 | HNP9 | 40.0 | — | 0.0 | 2.50 | 5° C./min |
| Comparative 5 | Comparative 5 | 1 | 1.0 | HNP9 | 15.0 | Dibehenyl sebacate | 5.0 | 0.05 | 5° C./min |
| Comparative 6 | Comparative 6 | 1 | 40.0 | HNP9 | 15.0 | Dibehenyl sebacate | 5.0 | 2.00 | 5° C./min |

| Toner No. | Toner particle No. | Holding time | Tcw particles (%) | Releasing agent domain diameter (μm) | Releasing agent coverage ratio (%) | Area ratio of crystalline polyester domains | Area ratio of releasing agent domains | Number of 5 to 500 nm domains |
|---|---|---|---|---|---|---|---|---|
| 1 | 1 | 100 min | 90 | 2.5 | 95 | 14.5% | 22.1% | 320 |
| 2 | 2 | 100 min | 91 | 2.4 | 93 | 14.1% | 21.5% | 310 |
| 3 | 3 | 100 min | 92 | 2.6 | 94 | 15.1% | 22.6% | 315 |
| 4 | 4 | 100 min | 95 | 3.6 | 95 | 21.8% | 22.4% | 482 |
| 5 | 5 | 100 min | 86 | 2.2 | 85 | 12.2% | 22.0% | 280 |
| 6 | 6 | 100 min | 85 | 1.1 | 91 | 10.0% | 10.2% | 80 |
| 7 | 7 | 100 min | 74 | 1.9 | 90 | 38.2% | 13.5% | 498 |
| 8 | 8 | 100 min | 87 | 1.2 | 97 | 10.5% | 10.2% | 77 |
| 9 | 9 | 60 min | 91 | 2.6 | 95 | 14.8% | 21.5% | 322 |
| 10 | 10 | 60 min | 90 | 2.1 | 89 | 12.1% | 21.0% | 47 |
| 11 | 11 | 30 min | 83 | 2.3 | 86 | 10.8% | 22.3% | 32 |
| 12 | 12 | 30 min | 72 | 3.3 | 80 | 10.2% | 38.1% | 45 |
| 13 | 13 | 30 min | 85 | 2.2 | 83 | 11.0% | 22.2% | 34 |
| 14 | 14 | 30 min | 80 | 3.8 | 81 | 10.6% | 39.4% | 33 |
| 15 | 15 | 0 min | 79 | 3.8 | 80 | 10.2% | 39.6% | 12 |
| 16 | 16 | 0 min | 80 | 3.9 | 31 | 10.1% | 39.9% | 10 |
| Comparative 1 | Comparative 1 | 0 min | 40 | 2.4 | 35 | 13.8% | 19.5% | 10 |
| Comparative 2 | Comparative 2 | 0 min | 46 | 2.0 | 43 | 13.6% | 17.5% | 11 |
| Comparative 3 | Comparative 3 | 30 min | 35 | 0.5 | 95 | 14.2% | 6.8% | 110 |
| Comparative 4 | Comparative 4 | 30 min | 56 | 4.2 | 93 | 14.1% | 10.0% | 114 |
| Comparative 5 | Comparative 5 | 30 min | 40 | 2.3 | 48 | 6.0% | 20.0% | 125 |
| Comparative 6 | Comparative 6 | 30 min | 90 | 2.4 | 95 | 59.0% | 20.5% | 280 |

In the table, "Releasing agent coverage ratio" means the coverage ratio of the releasing agent domains by the crystalline polyester. "Number of 5 to 500 nm domains" means the number of domains of the releasing agent and domains of the crystalline polyester with a maximum diameter of at least 5 nm and not more than 500 nm.

Example 1

The following evaluations were performed using the toner 1.

(Initial Developing Performance)

Using a LBP3410 (monochrome laser beam printer, Canon Inc.) as the image-forming apparatus, toner 1 was left standing for 1 day in a normal-temperature, normal-humidity environment (23° C./60% RH). A4 color laser copy paper (Canon Inc., 80 g/m$^2$) was used as the paper type. 5 copies of a solid image were output continuously in a normal temperature, normal humidity environment, and the printed image densities of the resulting 5 solid images were measured with a Macbeth reflection densitometer (GretagMacbeth GmbH). The worst value was taken as the solid density, and the higher the solid density, the better the evaluation of developing performance. The evaluation results are shown in Table 3.

(Fixing Performance)

Fox River bond paper (110 g/m$^2$) was used as the fixing medium. For the image-forming apparatus, the image-forming apparatus used in the evaluation of initial developing performance was modified to allow adjustment of the developing bias. Using a solid image as the image for evaluation, the quantity of toner on the image was increased by manipulating the developing bias and setting a higher reflected density of the solid part. Using a thick paper with relatively great surface irregularity makes the peeling conditions more severe because the toner is less likely to melt in the indentations of the paper or in the lower layer of the toner layer during the fixing process. In terms of the evaluation environment, the evaluation is also more stringent at a lower temperature because the fixing unit is harder to warm up.

The evaluation procedures are as follows. The image-forming apparatus was left overnight in a low-temperature, low-humidity environment (15° C., 10% RH). A solid image was then printed on Fox River bond paper with the developing bias adjusted to obtain an image density (as measured with a Macbeth reflection densitometer (GretagMacbeth GmbH)) of at least 1.5 and not more than 1.55. This was then left again in a low-temperature, low-humidity environment for 1 hour, 5 copies of a solid image were output at the adjusted bias settings, and the 5 solid images were rubbed 10 times with 1 sheet of Silbon paper under 55 g/cm$^2$ of load. After being rubbed, the solid images were visually evaluated as follows using the Silbon paper used for rubbing. Peeling was evaluated by determined whether there were any parts that had become white in the solid image part, and whether there were any parts with lower adhesive force to the paper rubbed with the Silbon paper. A rating of D or better is considered good in the present invention.

A: No peeling observed after rubbing, solid image remains uniform

B: No peeling observed after rubbing, solid image remains uniform but Silbon paper slightly stained C: No peeling observed after rubbing, solid image remains uniform but Silbon paper clearly stained D: Some peeling observed after rubbing, and some peeling also seen in the solid image before rubbing E: Peeling observed after rubbing, and obvious peeling also seen in the solid image before rubbing (Durability after Long-Term Storage)

For purposes of the evaluation, a sleeve 10 mm in diameter was mounted as a developing sleeve on the LBP-3410 used as the image-forming apparatus in the evaluation of initial developing performance. Under these conditions, because the developing sleeve is small, the pressure between the toner and the developing sleeve tends to be higher, and melt adhesion to the developing sleeve is more likely. Moreover, crystalline materials such as the releasing agent may be exuded onto the surface during long-term storage in a high-temperature environment, potentially affecting the image quality. To make the evaluation more stringent, therefore, the toner was left in such an environment as described below before the evaluation.

Specifically, the toner was left in a thermostatic tank adjusted to 22° C., 90% RH, and aged for 24 hours. The temperature was then raised at a rate of 17.5° C. an hour, reaching 57° C., 90% RH after 2 hours. This was then held for 2 hours in this state, and the temperature was lowered at a rate of 17.5° C. an hour to 57° C., 90% RH. This was held for 2 hours, and then heated again. This temperature rise and temperature decrease between 22° C., 90% RH and 57° C., 90% RH was repeated 10 times. By thus exposing the toner to extreme thermal fluctuation, with repeated cycles of high and low temperatures, it is possible to promote material transfer inside the toner, and test its resistance to long-term storage. Durability can be evaluated stringently by combining these conditions.

As the evaluation procedures, the image-forming apparatus was left overnight in a high-temperature, high-humidity environment (32.5° C., 80% RH), 15,000 copies of a horizontal line image were output in intermittent mode at a print percentage of 1% in the same environment, and three copies of a solid white image were output. For the image quality evaluation, the final three solid white images were evaluated for image streaks, and the developing sleeve was also observed. A rating of C or better is considered good in the present invention.

A: No image streaks

B: No image streaks, but toner laid-on level irregularities observed on developing sleeve C: Faint streaks observed on image D: Obvious streaks observed on image Examples 2 to 16

The same image output test was performed as in Example 1 except that toner 1 in Example 1 was replaced with toners 2 to 16. The evaluation results are shown in Table 3.

Comparative Examples 1 to 6

The same image output test was performed as in Example 1 except that toner 1 in Example 1 was replaced with comparative toners 1 to 6. The evaluation results are shown in Table 3.

TABLE 3

| | Initial developing performance (image density) | Fixing performance (peeling) | Durability after long-term storage (image streaks) |
|---|---|---|---|
| Example 1 | 1.52 | A | A |
| Example 2 | 1.52 | A | A |
| Example 3 | 1.52 | A | A |
| Example 4 | 1.53 | A | A |
| Example 5 | 1.53 | A | A |
| Example 6 | 1.52 | B | A |
| Example 7 | 1.53 | B | A |
| Example 8 | 1.52 | B | B |
| Example 9 | 1.53 | B | B |
| Example 10 | 1.52 | A | C |
| Example 11 | 1.48 | B | C |
| Example 12 | 1.43 | B | C |
| Example 13 | 1.42 | B | C |
| Example 14 | 1.42 | C | C |
| Example 15 | 1.38 | C | C |
| Example 16 | 1.33 | D | C |
| Comparative Example 1 | 1.48 | E | C |
| Comparative Example 2 | 1.38 | E | D |
| Comparative Example 3 | 1.47 | E | B |
| Comparative Example 4 | 1.33 | C | D |
| Comparative Example 5 | 1.53 | E | B |
| Comparative Example 6 | 1.32 | A | D |

The present invention can provide a toner that is resistant to peeling, and provides a stable image even after long-term storage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-085323, filed Apr. 21, 2016, which is hereby incorporated by reference herein in its entirety.

What is claimed is:

1. A toner comprising toner particles, each of which contains a binder resin, a colorant, a releasing agent and a crystalline polyester, wherein in an observation of a cross-section of each of the toner particles by transmission electron microscopy, specific toner particles, each of which has domains of the crystalline polyester and domains of the releasing agent, are present at a ratio of at least 70% by number of the toner particles in the toner, an arithmetic mean of maximum diameters of the domains of the releasing agent is at least 1.0 μm and not more than 4.0 μm, and the specific toner particles satisfy conditions (i) to (iii):

(i) an average coverage ratio of the domains of the releasing agent by the domains of the crystalline polyester is at least 80%;

(ii) an average ratio of an area occupied by the domains of the crystalline polyester to a cross-sectional area of each of the specific toner particles is at least 10.0% and not more than 40.0%; and (iii) an average ratio of an area occupied by the domains of the releasing agent to a cross-sectional area of each of the specific toner particles is at least 10.0% and not more than 40.0%.

2. The toner according to claim 1, wherein the binder resin is made primarily of a styrene acrylic resin.

3. The toner according to claim 1, wherein in the cross-section of each of the toner particles observed by transmission electron microscopy, a total number of the domains of the releasing agent and domains of the crystalline polyester having a maximum diameter of at least 5 nm and not more than 500 nm is at least 50 and not more than 500 per individual toner particle cross-section.

4. The toner according to claim 1, wherein the crystalline polyester has a terminal structure derived from an acid monomer selected from the group consisting of lauric acid, stearic acid and behenic acid.

* * * * *